United States Patent [19]

Tanaka et al.

[11] Patent Number: 4,816,864

[45] Date of Patent: Mar. 28, 1989

[54] PROGRAMMABLE COPYING APPARATUS

[75] Inventors: Susumu Tanaka; Kenji Shibazaki, both of Aichi; Keiji Nakatani, Toyokawa, all of Japan

[73] Assignee: Minolta Camera Kabushiki Kaisha, Osaka, Japan

[21] Appl. No.: 74,296

[22] Filed: Jul. 16, 1987

Related U.S. Application Data

[63] Continuation of Ser. No. 799,910, Nov. 20, 1985, abandoned.

[30] Foreign Application Priority Data

| | | | |
|---|---|---|---|
| Nov. 22, 1984 | [JP] | Japan | 59-247798 |
| Nov. 27, 1984 | [JP] | Japan | 59-251256 |
| May 1, 1985 | [JP] | Japan | 60-94681 |
| May 27, 1985 | [JP] | Japan | 60-114661 |

[51] Int. Cl.[4] ..... G03G 21/00

[52] U.S. Cl. ..... 355/14 R; 355/14 CU

[58] Field of Search ..... 355/3 R, 3 SH, 14 R, 355/14 SH, 14 CU

[56] References Cited

U.S. PATENT DOCUMENTS

| | | | |
|---|---|---|---|
| 3,687,540 | 8/1972 | Hashimoto | 355/14 |
| 4,305,653 | 12/1981 | Evanitsky | 355/14 R X |
| 4,442,505 | 4/1984 | Takano | 355/14 R X |
| 4,453,821 | 6/1984 | Smith | 355/14 C |

FOREIGN PATENT DOCUMENTS

| | | |
|---|---|---|
| 55-50260 | 4/1980 | Japan . |
| 56-94366 | 7/1981 | Japan . |
| 57-90651 | 6/1982 | Japan . |

*Primary Examiner*—Fred L. Braun

*Attorney, Agent, or Firm*—Price, Gess & Ubell

[57] ABSTRACT

A programmable copying apparatus is provided which permits an operator to be informed of the exact time that the copying operation input by him into the machine will be completed, even with multiple copying operations.

10 Claims, 21 Drawing Sheets

83
RAM 1
86
PA 0
1
2
3
4
5
6
7
Vcc
7 6 5 4 3 2 1 0
PB 0
1
2
9 8
F3 F2 F1 F0
PC 0
1
2
4
5
6
7
green
orange
blue
161
1st stage
2nd stage
3rd stage
4th stage
PD
0~3
4~7
clock read
io controller
CLK
S out
Sin
INT
operation CPU
80
81
CLK
Sin
S out
OUT(INT)
CLK (g)
copier CPU
RAM 2
84
CLK
Sout
Sin
INT
ADF CPU
82
DISP 1
segment
bit
87
171
DISP 2
segment
bit
88
170
io controller
89
85
RAM 3
input sensors
output sensors

PROGRAMMABLE COPYING APPARATUS

This is a continuation application of Ser. No. 799,910, filed on Nov. 20, 1985, now abandoned.

FIELD OF THE INVENTION

The present invention relates to a programmable copying apparatus, and more particularly to a programmable copying apparatus having plural document support tables, wherein copying conditions can be preset to the respective documents set on the respective document support tables and the copying process can be automatically carried out under the preset conditions.

DESCRIPTION OF THE PRIOR ARTS

Conventional copying apparatuses include one in which copying cycle is carried out with the document manually set at the exposing position and one in which a copying cycle is carried out with the documents automatically set at the exposing position, one by one, from a stack of documents placed on a document support table.

These copying apparatuses often cause inconveniences in that the next operator must wait until completion of the copying cycle by the first one. This is particularly troublesome when the first operator is required to make a large quantity of copies.

To solve the above-described drawbacks, the specification of U.S. Pat. No. 3,687,540 and Japanese Laid-open Patent Application No. SHO 55-50260 propose copying apparatuses including plural document support tables, wherein copying conditions can be preset to the respective documents set on the respective document support tables and the copying cycle can be automatically carried out under the preset conditions.

However, the above-described copying apparatuses impart no information to the operator about the completion time of the preset copying cycle. Therefore, the operator having the copying condition preset or reserved is required to make a frequent confirmation to see whether the preset copying cycle has terminated.

Further, the copying apparatuses described above require a troublesome operation of setting copying conditions separately even in the case of setting the same copying conditions.

Moreover, said copying apparatuses are incapable of automatically erasing the preset conditions (copying conditions) even after the completion of the preset copying cycle. This misleads the next operator to set documents under the same copying conditions as the previous ones, to thereby cause unwanted copies.

Additionally, said conventional copying apparatuses provide difficulty in identifying the preset conditions for the plural document support tables, i.e., whether the tables are being preset or having completed the preset conditions. Accordingly, the operator may become misled to place new documents on the table waiting to feed documents under the already preset conditions.

SUMMARY OF THE INVENTION

The primary object of the present invention is to provide a programmable copying apparatus capable of presetting copying conditions for efficiently effecting copying cycles.

Another object of the present invention is to provide a programmable copying apparatus which provides the time of the completion of the preset copying cycle.

Still another object of the present invention is to provide a programmable copying apparatus wherein preset conditions can be erased after the completion of the preset copying cycle.

Still another object of the present invention is to provide a programmable copying apparatus which is capable of identifying preset states of respective document support tables.

To achieve these and the above objects, a copying apparatus according to the present invention comprises a plurality of document support means for supporting documents to be copied, document feed means for feeding the documents from said document support means to a copy station, copy means for copying the document fed on the copy station, memory means having a plurality of memory areas corresponding to said document support means for memorizing copy conditions of each document group supported by said document by said document support means, input means for inputting the copy conditions of each document group into each memory area of said memory means, copy control means for controlling the document feed operation of said document feed means and copy operation of said copy means under said copy conditions memorized in said memory means, time calculate means for calculating a completion time of the copy operation under the input condition on every input operation corresponding to the plurality of document support means, and display means for displaying said completion time.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

PREFERRED EMBODIMENTS

Figure 1:
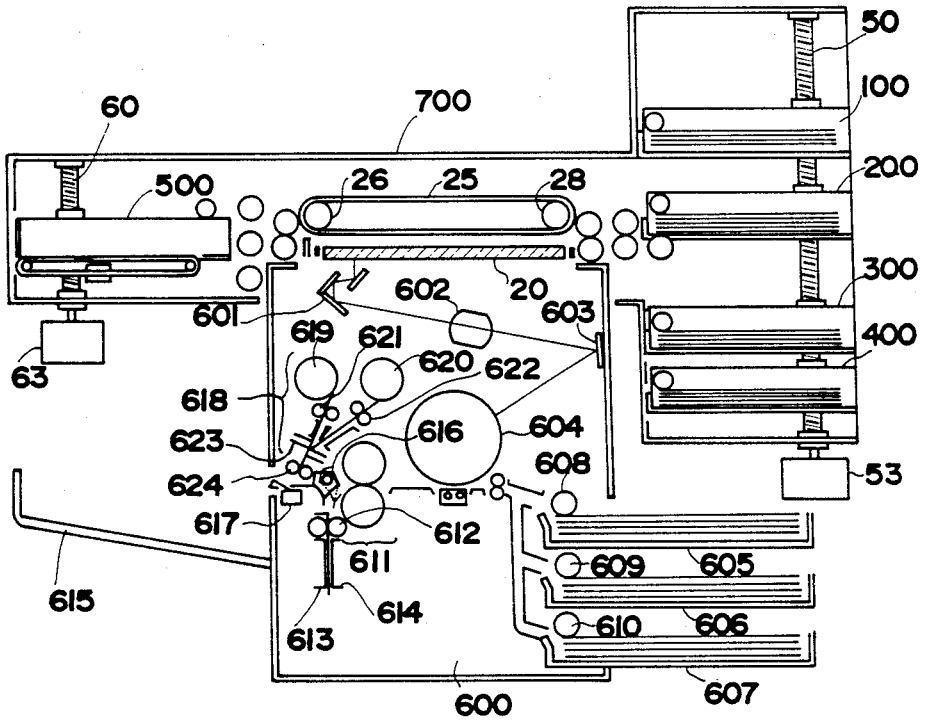
FIG. 1 is a schematic sectional view of a programmable copying apparatus according to the present invention.

FIG. 1 illustrates a copying machine in which the present invention is applied. This copying machine is roughly composed of a copying machine body (600) for copying an original document to be placed on a document support table (20) and an automatic document feeder (hereinafter referred to as ADF) (700) which is provided on the copying machine body (600) and automatically sets an original document on the document support table (20).

The copying machine body (600) comprises a scanning optical system including a movable mirror (601), a projection lens (602) and a fixed mirror (603), and image forming part including a photosensitive material drum (604), corona chargers provided around said drum, an eraser, a developer and a cleaner (not shown), a copying paper feed part including copying paper feed cassettes (605), (606), (607) and copying paper feed rollers (608), (609), (610), a fixing part consisting of a heat roller (611), a reversing part including a reversibly rotatable reversible roller (612) and reversing guide plates (613), (614) provided opposite to each other, a change-over cam (616) which changes the discharging direction of copying papers discharged from the heat roller (611) to the reversing part or paper discharge tray (615), and an discharging paper detection switch (617) which detects discharge of copying papers.

Moreover, the copying machine body (600) is provided with a marker paper insertion of unit (618) for insertion a marker papar to the copying papers to be accommodated on the paper discharge tray (615). This marker paper insertion unit (618) is composed of the two kinds of marker papers (619), (620), marker paper supply rollers (621), (622), a cutter (623) and a marker paper discharge roller (624) and it is capable of discharging, if required, the necessary kinds of marker papers on the paper discharge tray (615). For example, in case the copying is carried out respectively in the predetermined number of papers for a plurality of original documents, partitioning can be done for each copying group corresponding to the original documents by operating the marker paper insertion unit (618) for each end of copying for a predetermined number of papers corresponding to respective original documents.

On the other hand, the ADF (700) generally comprises an endless type supply belt (25) provided opposite to the document support table (20), document trays (100), (200), (300), (400) provided in multistages in contact with the one end of said supply belt (25) and an intermediate tray (500) provided adjacent to the other end of said supply belt. This ADF (700) sequentially transfers, for example, the documents being set in the document tray (200) to the supply belt (25) which sets the documents on the document support table (20), accommodates the documents after copying in the intermediate tray (500). When the document tray (200) becomes empty, the document is transferred to the supply belt (25) from the intermediate tray (500) for copying and the documents after copying are accommodated within the document tray (200). The ADF (700) executes a series of document transfer operations described above until the copying of a predetermined number of sheets is completed.

Figure 2:
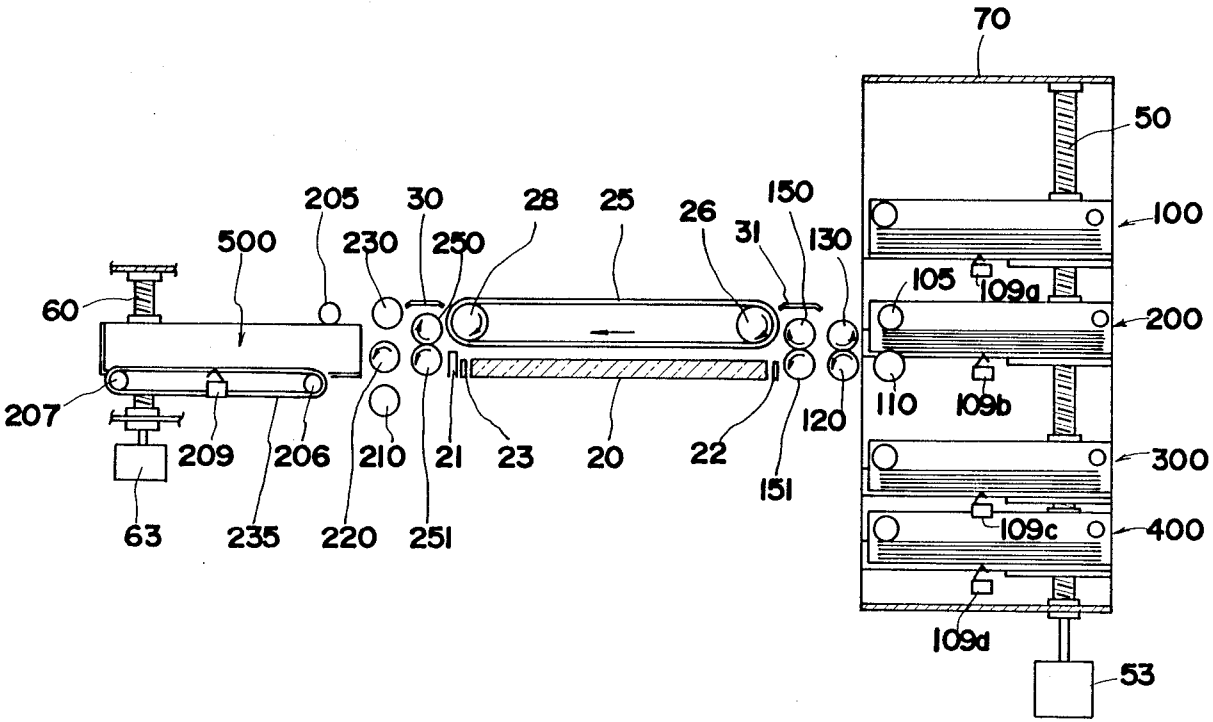
FIGS. 2 through 4 are explanatory views of the operation of an automatic document feeder.
Figure 3:
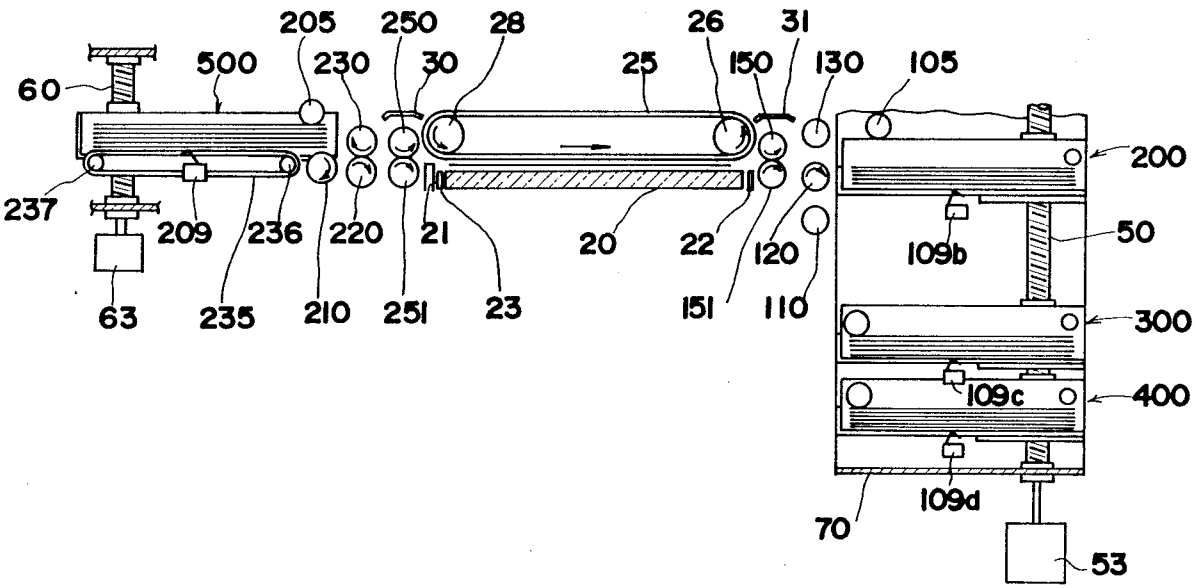
Figure 4:
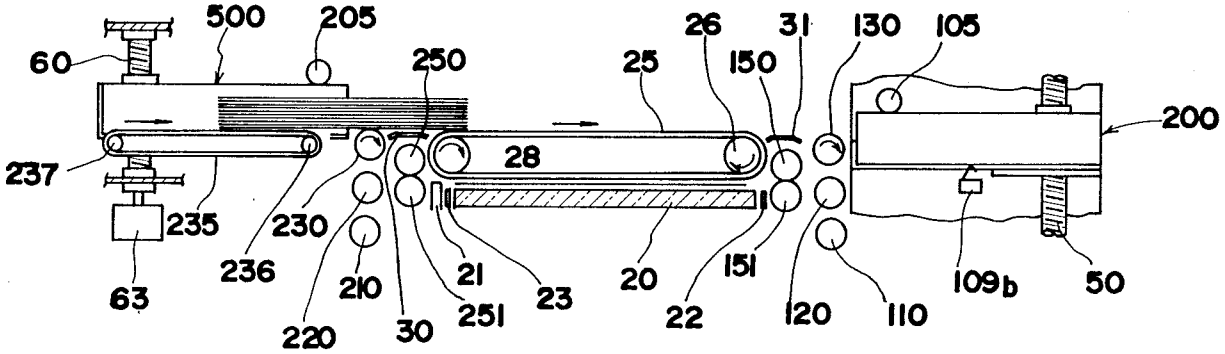

Construction of the foregoing ADF (700) is explained in detail with respect to FIG. 2 to FIG. 4.

The supply belt (25) is extended between the support rollers (26), (28) and it can provide a reversible drive, slidably on the document support table (20).

The multistage document trays (100), (200), (300), (400) are provided in a multistage arrangement in the vertical direction to a frame body (70) which is provided at the right end of the document support table (20) and it can be moved upward and downward by an up-and-down spindle (50) rotatably driven by a motor (53). Focussing on the document tray (200), it can be set at the document sending position shown in FIG. 2, the document receiving position shown in FIG. 3 and the document lump receiving position shown in FIG. 4. The inermediate tray (500) of a single stage disposed at the left end of the document support table (20) can be moved upward and downward by the up-and-down spindle (60) rotatably driven by the motor (63) and can be set at the document receiving position shown in FIG. 2, the document sending position shown in FIG. 3 and at the document lump sending position shown in FIG. 4.

These document trays (200), (500) are respectively provided with paper feed rollers (110), (210) and document detection switches (109*b*), (209). The paper feed roller (110) can be located by switching at the paper feeding position indicated by a solid line in FIG. 2 and the shunting position indicated by a solid line in FIG. 3 and FIG. 4. Another paper feed roller (210) can be located by switching at the paper feeding position indicated by a solid line in FIG. 3 and the shunting position indicated by a solid line in FIG. 2 and FIG. 4.

Meanwhile, the paper transporting rollers (120), (220), the handling rollers (130), (230) being in contact therewith from the upper side and two pairs of capstan rollers (150), (151), (250), (251) being vertically in contact with each other, are provided between both ends of the document trays (200). The intermediate tray (500) and the document support table (20) and the handling rollers (130), (230) can be located by switching to a position being in contact with the paper transporting rollers (120), (220) or at the shunting position to the upper side. Moreover, a stopper (21) and document detection sensors (22), (23) are provided and the stopper (21) can be located by switching at the position protruding over the document support table (20) or to a shunting position to the lower side.

The copying machine of the present invention sequentially transfers the documents from the document tray (200) or intermediate tray (500) to the other tray (200) or (500) through the document support table (20). Upon completion of such a supply of documents, it repeats its operation to feed the documents in the reverse direction as many times as the predetermined number of copying operations. Therefore, the supply belt (25) and various rollers may be reversely rotated. With such a presumption that the operation of feeding the documents from the document tray (200) is regarded as the mode A, while the operation of feeding from the intermediate tray (500) as the mode B, as shown in FIG. 2 in the case of the mode A, the document tray (200) is set at the sending position and the intermediate tray (500) at the receiving position, the paper feed roller (110) at the paper feeding position, paper feed roller (210) at the shunting position and the handling roller (230) at the shunting position to the upper side. The supply belt (25) and other various rollers are respectively rotatably driven in the direction of arrow mark. This rotating direction is defined as the normal rotating direction.

In this mode A, the documents placed on the document tray (100) is taken one sheet by one sheet from the lowest by the normal rotation of the paper feed roller (110) and is then transferred to the left side through the paper transporting roller (120), handling roller (130) and capstan rollers (150), (151). Next, the document is fed to the left side on the document support table (20) by the normal rotation of the supply belt (25). When the end of the document collides with the stopper (21) and is simultaneously detected by the sensor (23), rotation of the supply belt (25) halts and the document is positioned by the stopper (21) and is stopped. In this state, exposure is started and when exposure is completed, the stopper (21) is withdrawn to the lower side and simultaneously the supply belt (25) starts again the normal rotation. Thereby, the document is further fed to the left side and is received by the intermediate tray (500) from a position between the paper transporting roller (220) and handling roller (230), owing to the sending force of the capstan rollers (250) and (251) and then stacked therein sheet by sheet. Such operations are repeated succeedingly until completion of the last sheet feeding. When the last document sheet is sent out from the document tray (200), a switch (109) turns OFF. As a result, the mode A is completed and the operation mode transfers to the mode B.

In the operation mode B, as shown in FIG. 3, the intermediate tray (500) is located by switching at the sending position, the document tray (200) at the receiving position, the paper feed roller (210) at the paper feeding position, the paper feed roller (110) at the shunting position, the handling roller (130) at the upper shunting position and the stopper (21) is shunted to the lower side. Moreover, the supply belt (25) and various rollers are driven rotatably in the direction of arrow mark opposite to the direction in the mode A. This rotating direction is defined as the reverse rotation.

In this mode B, the documents placed in the intermediate tray (500) are sent sheet by sheet from the lowest side by the reverse rotation of the paper feed roller (210) and such documents are transferred to the right sheet by sheet by the paper feed roller (220), handling roller (230) and capstan rollers (250), (251). Next, a reverse rotation of the supply belt (25) feeds the documents to the right side on the document support table (20). When some periods have passed after the sensor (23) detects the passing of the rear end of the document, the supply belt (25) is switched to the normal rotation and simultaneously the stopper (21) protrudes upward. Thereby the document is returned a little to the left side and the rear end collides with the stopper (21) and is detected by the sensor (23). Rotation of supply belt (25) is thus stopped and the exposure is started as explained above. Upon completion of exposure, the supply belt (25) starts again the reverse rotation, and the documents are transferred to the right side and are received by the document tray (200) from the position between the handling roller (130) and paper transporting (120), owing to a sending force of the capstan rollers (150), (151) and are then stacked therein. Such operations are repeated until completion of the last sheet feeding. When the last sheet is sent out from the document tray (200), a switch (209) turns OFF. To complete the mode B and the mode A is started again.

After repetition of the operation modes A and B for a predetermined number of times of copying, the copying operations are complete.

In the present copying machine, when the copying for predetermined number of sheets for a stack of original documents placed in the one original document tray (200) is completed, other documents trays (100), (300), and (400) are moved upward or downward and the copying for a stack of documents placed therein is carried out respectively for the predetermined number of sheets in the mode A and mode B.

Meanwhile, in the present copying machine, the first documents are transported to the intermediate tray (500) from the document tray (200), and in case of odd numbers of copying sheets, the documents are left in the intermediate tray (500). Therefore it is necessary to return a stack of documents to the document tray (200) from the intermediate tray (500) at that time.

For this purpose, a send belt (235) is provided at the bottom of the intermediate tray (500) and the guide plates (30),(31) are also provided above the capstan rollers (150), (250). Namely, at the time of feeding a stack of documents in the document tray (200) at a time, as shown in FIG. 4, the document tray (200) and the intermediate tray (500) are set at a position feeding a stack of documents, the paper feed rollers (115), (210) are located by switching to the shunting position and the handling rollers (130), (230) are also located by switching to the upper shunting position. In this state, a rotatable drive in the arrow direction for the send belt (235), supply belt (25) and handling rollers (130), (230) causes the transfer of a stack of documents at a time to the document tray (200) from the intermediate tray (500) through the supply belt (25).

Figure 5:
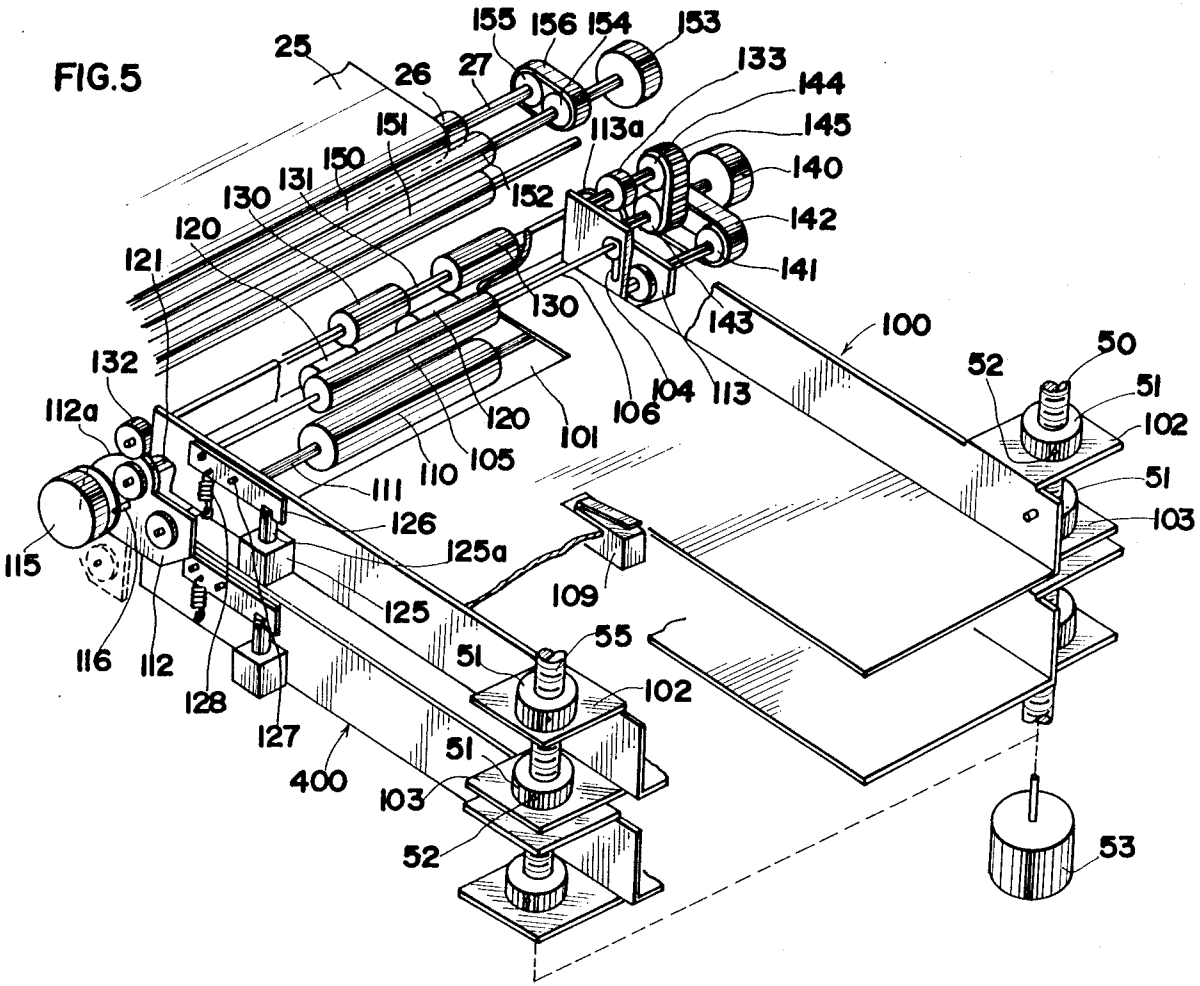
FIG. 5 is a perspective view of a document support table.
Figure 6:
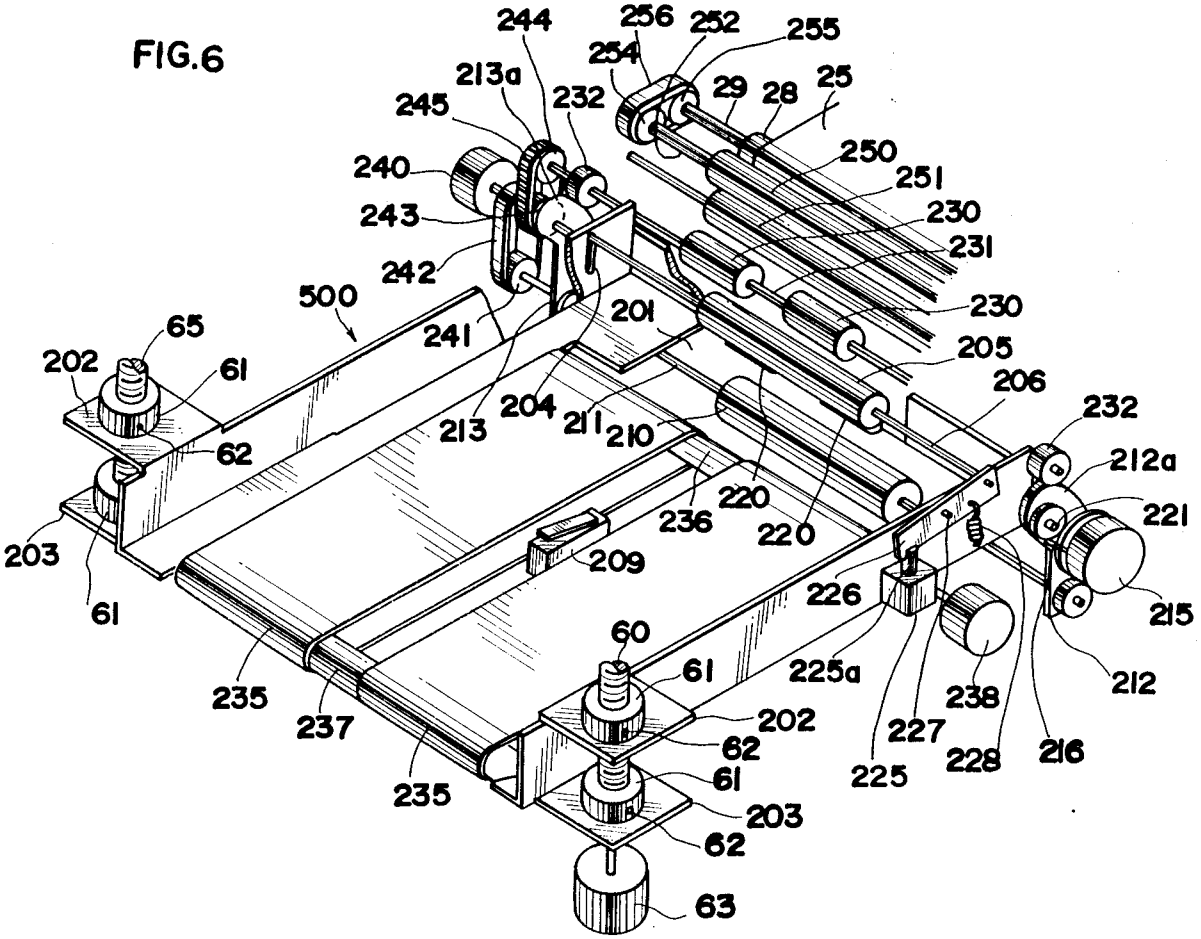
FIG. 6 is a perspective view of an intermediate document support table.

Construction of the present copying machine is explained in further detail with respect to FIG. 5 and FIG. 6

The paper feed rollers (110), (210) are rotatably and removably supported by the levers (112), (113) and (212), (213) at both ends of support spindles (111), (211) thereof and the levers (112), (113) and (212), (213) are rotatably and removably supported at both ends of support spindles (121), (221) of paper transporting rollers (120), (220). These support spindles (121), (221) are rotatably provided to a frame of the copying machine body. Moreover, the frame of the copying machine body is provided with the rotary solenoids (115), (215) and the drive pins (116), (216) thereof are coupled to the levers (112), (212).

The handling rollers (130), (230) are fixed to the support spindles (131), (231) and upper and lower positions of these rollers are restricted by contact from the upper side of the cam followers (132), (133) and (232), (233) attached to the both ends of the support spindles (131), (231) with the cam surfaces (112*a*), (113*a*), (212*a*), (213*a*) of said levers (112), (113) and (212), (213). Namely, the levers (112), (113) and (212), (213) are caused to rotate around the support spindles (121), (221) as the fulcrums by spinning of the drive pins (116), (216) based on the ON and OFF states of the rotary solenoids (115), (215). As the function of sending, as shown in FIG. 5, the rotary solenoid (115) is turned ON, the levers (112), (113) are lifted in the horizontal condition, and the paper feed roller (110) collides with a document (not illustrated) from a cut-away part (101) of the document tray (200). In addition, cam followers (132), (133) contact with the small-diameter portions of the cam surfaces (112*a*), (113*a*) and the handling roller (130) moves downward and contacts with the paper transporting roller (120).

It is also the same in case another rotary solenoid (215) is also turned ON.

Meanwhile, for the function of receiving, with respect to FIG. 6, the rotary solenoid (215) is turned OFF, the levers (212), (213) are rotated almost in a vertical position and the paper feed roller (210) is withdrawn downward. The cam followers (232), (233)

contact with the large-diameter portions of the cam surfaces (212*a*), and (213*a*) and the handling roller (230) moves upward, to be isolated from the paper transporting roller (220). It is also the same in the case when the rotary solenoid (115) is turned OFF.

Moreover, the keep rollers (105), (205) are rotatably attached to the front ends of levers (126) and (226) through the support spindles (106), (206), the levers (126), (226) are loaded to the side plates of the document trays (100), (200) rotatably around the pins (127), (227) as the fulcrums. At the rear end thereof, the actuators (125*a*), (225*a*) of solenoids (125), (225) are coupled. The keep rollers (105), (205) are urged downward with tensile springs (128), (228) when the solenoids (125), (225) are turned OFF, pressing a document not illustrated. In other words, the solenoids (125), (225) are turned OFF only when the document tray (200) and intermediate tray (500) function as the sending side. In case it functions as the receiving side, or in the case of a lump supply, the solenoids (125), (225) are turned ON and the keep rollers (105), (205) are drawn upward. The upward and downward movements of keep rollers (105), (205) are guided by elongated holes (104), (204) formed at the side plates of the document tray (200) and intermediate tray (500).

As the rotary drive source, the paper feed motors (140), (240) and the belt drive motor (153) are prepared. The paper feed motors (140), (240) couple the output spindles thereof to the one end of support spindles (121), (221) of said supply rollers (120), (220). The rotating drive force of such motors is transmitted not only to the paper transporting rollers (120), (220) but also to the paper feed rollers (110), (210) by extending the belt (142) to the pulleys (not illustrated) fixed to the support spindles (121), (221) and the pulleys (141), (241) fixed to the support spindles (111), (211) and it is also transmitted to the handling roller (130) by extending the belts (145), (245) to the pulleys (143), (243) fixed to the support spindles (121), (221) and to the pulleys (144), (244) fixed to the support spindles (131), (231). The belts (145), (245) are made of an expandable and compressible material for the changeover of locations of the keep rollers (105), (205).

The belt drive motor (153) is coupled to the one end of support spindle (152) of the capstan roller (150) and its rotating drive force is transmitted not only to the capstan roller (150) but also to the support belt through the support roller (26) by extending the belt (156) to the pulley (154) fixed to the support spindle (152) and the pulley (155) fixed to the support spindle (27) of support roller (26) of the supply belt (25). Moreover, in the intermediate tray (500), a rotating drive force of the belt drive motor (153) is transmitted also to the capstan roller (250) by extending the belt (256) to the pulley (255) fixed to the support spindle (29) of the support roller (28) and the pulley (254) fixed to the support spindle (252) of the capstan roller (250). The lower capstan rollers (151), (251) rotate with the upper rollers (150), (250) in contact therewith.

Meanwhile, the send belt (235) provided at the bottom part of intermediate tray (500) is wound endlessly to the support rollers (236), (237) and are rotatably driven by a lump send motor (238) coupled to the support roller (236). As shown in FIG. 4, the send belt (235) is rotatably driven only in the clockwise direction only when a stack of documents is fed to the document tray (100) from the document tray (200).

The upward and downward movements of the document tray (200) and intermediate tray (500) will then be explained hereunder.

The bearings (51), (61) are fixed to the protruded pieces (102), (103) and (202), (203) formed in both sides of document trays (100), (200), these bearings (51), (61) are engaged with the up-and-down spindles (50), (55) and (60), (65), and the pins (52), (62) protruded from the side of bearings (51), (61) are engaged with helical groove of the up-and-down spindles (50), (55) and (60), (65). The lower ends of up-and-down spindles (50), (60) are coupled with the up-and-down motors (53), (63). The rotating forces of these motors (53), (63) can be transmitted to the up-and-down spindles (50), (55), (60), (65). As the up-and-down motors (53), (63), stepping motors of which a number of rotations can be controlled accurately are used. Reversible rotations of such motors cause the up-and-down spindles (50), (55), (60), (65) to be rotatably driven in reversible. Thereby, the document tray (200) and intermediate tray (500) move upward and downward in accordance with the pitch of are helical groove and the document tray (200) and intermediate tray (500) are positioned in such a height as the rotation stop position. In order to move upward and downward a plurality of document trays (100), (200), (300), (400), the up-and-down spindles (50), (55) allow the formation of a helical groove with a dense pitch at the upper and lower ends and a coarse pitch at the central area. Namely, upward and downward movement of a tray for a single turn of the up-and-down spindle (50) at the upper and lower end portions is set less than that at the central portion, in view of forming a compact structure through a short up-and-down stroke of the multistage tray as a whole.

Figure 7:
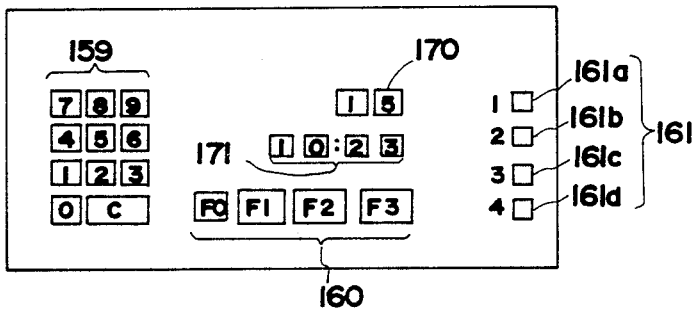
FIG. 7 is a plan view of a control panel employed for presetting copying conditions.

FIG. 7 shows an operation panel provided for the copying machine and copying conditions for the document trays (100), (200), (300), (400) can be reserved by a keying operation at the operation panel.

This operation panel is provided with the numeral keys 0 to 9, clear key (159), function keys $F_0 \sim F_3$ (160), the numeral display (170) which displays numeral key inputted, the time display (171) which displays the time and four display windows (161) for displaying reserving and processing conditions for the document trays (100), (200), (300), (400).

Each display window (161) is provided with lamps for displaying three different colors and is capable of displaying the conditions of document trays (100), (200), (300), (400) with different colors in accordance with the conditions thereof. For example, the display window (161*a*) lights up in orange when the copying conditions is reserved to the document tray (100), or in blue when the copying is carried out under the reserved condition, or in green when the copying condition is not reserved.

The numeral display (170) and time display (171) are provided, for example, with a 7-segment liquid crystal display. The time display (171) displays the time of completing the copying under the reserved condition set by the keying operation at the operation panel.

The function keys $F_0 \sim F_3$ (160) are provided for reserving the copying conditions by programs. The key $F_0$ is used for inputting the size code of copying paper, $F_1$ key for a number of copies, $F_2$ key for a number of sheets of original documents, $F_3$ key for number of stages of document tray of ADF, respectively. The size code of copying paper can be inputted in the correspondence between numeral and size, for example, the size A4 is defined by numeral "1", size B4 by numeral "2".

If copying is required under the following copying conditions:

5 documents at the 1st stage, 15 copies in size A4,
3 documents at the 2nd stage, 20 copies in size A4,
10 documents at the 3rd stage, 5 copies in size B4,
7 documents at the 4th stage, 7 copies in size B4, such copying condition can be reserved by inputting as follow:

$1 \rightarrow F_0 \rightarrow 15 \rightarrow F_1 \rightarrow 5 \rightarrow F_2 \rightarrow 1 \rightarrow F_3$ $1 \rightarrow F_0 \rightarrow 20 \rightarrow F_1 \rightarrow 3 \rightarrow F_2 \rightarrow 2 \rightarrow F_3$ $2 \rightarrow F_0 \rightarrow 5 \rightarrow F_1 \rightarrow 10 F_2 \rightarrow 3 \rightarrow F_3$ $2 \rightarrow F_0 \rightarrow 7 \rightarrow F_1 \rightarrow 7 \rightarrow F_2 \rightarrow 4 \rightarrow F_3$ In case the same operator hopes to copy in the same number of sheets for different document groups, such complicated operations can be saved. For example, when the document group is respectively placed in each stage and copying is required for 7 sheets in each stage, if a number of stages is not designated such as $7 \sim F_1 \sim F_3,$ the copying in the same numbers can be realized for each document group placed in each stage by checking the documents in the document tray and reservation conditions. Moreover, if copying for only one sheet is required for all document groups, since a number of sheets of copying is generally initialized to "1", a keying input of only the key "$F_3$" is the input instruction for the copying of a sheet for all document groups. Further, when a document is placed in the stage of an empty condition and key "$F_3$" is input, reservation for the copying of a sheet can be realized after judging automatically the stage number.

The present invention, as described above, realizes the copying operations in accordance with the reserved sequence for the number of stages by preset loading a pluality of document groups to a plurality of stages without designation of stages and inputting the key "$F_3$" (cut off the number of stages, reservation and registration), and thereby labor can be saved for the copying under the same conditions and reservation in the initial mode (for example, copying of a sheet in the size A4). This copying machine is provided with a preliminary time informing function for disclosing a copying end time as described later but if a number of documents is not inputted by the keying operation as in the case of the above example, the preliminary time informing function is disabled and the copying end time is not informed.

Figure 8:
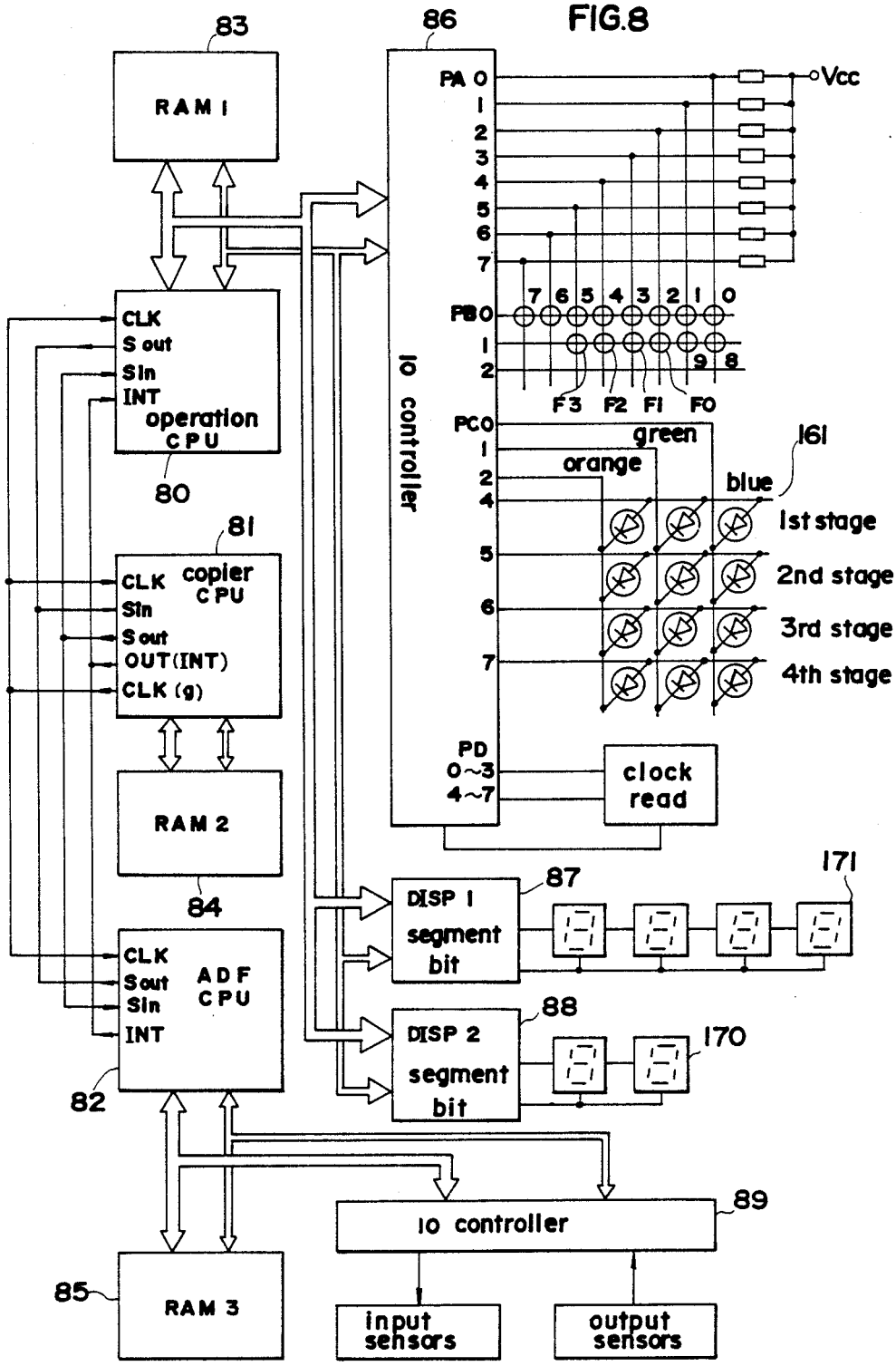
FIG. 8 is a circuit diagram for controlling the copying apparatus.

A circuit structure of this system is shown in FIG. 8, and is composed of an operation CPU (80), a copying machine CPU (81) and an ADF CPU (82). Each CPU comprises an interface for serial data transfer so that serial data can be sent and received between respective CPUS.

Each CPU has a RAM (83)~(85). The CPU (80) of the operation part is connected with IO controllers (86) and display controllers (87), (88) for 7-segment display (Disp 1, disp 2 . . . for example, uPD8279C-5(NEC) having the function of converting the display data to 7-segment display signal and displaying it). The first display controller (87) displays time on the time display (171), while the second display controller (88) displays the size of copying paper, number of copies, number of documents and number of stages on the numeral display (170). The 10 controller (86) allows the inputs of ten keys and function keys in the matrix form and the keying conditions are all inputted to the IO controller (86) passing the PA, PB ports. The PC port is an output port connected with a display (161) which displays document conditions of document trays of the 1st to 4th stages. The PD port is an IC unit for clock, for a example, MSM5832R3 which is connected to the IC for a clock which is capable of reading or writing the time, and said PD port sends or receives time data from the CPU (80) of the operation part through the IO controller (86). The controllers (86)~(88) described above have the function to control the loads connected to the ports of respective controllers on a time sharing basis with a single instruction sent from the CPU (80) of the operation part and therefore there are unnecessary to be always controlled by the CPU.

The copying machine CPU (81) is connected with element conrollers of the copying machine for data transfer therewith but these are not illustrated. The ADF CPU (82) includes an IO controller (89) which inputs the data from various sensors and outputs the signals to various drivers. The clock pulse generating terminal CLK (g) of the copying machine CPU (81) which is the host CPU is connected with the clock pulse input terminal (CLK) of the copying machine CPU (81), operation part CPU (82), the serial out terminal (Sout) of copying machine CPU (81) is connected to the serial in terminal (Sin) of each CPU, the OUT terminal of copying machine CPU is connected to the interrupt termianl INT of the CPU in the slave side. Thereby, the data transfer is carried out between the CPU and the CPU in the slave side fetch the necessary data based on the option codes and transmit such data. Such communication system is already disclosed in the U.S. patent application Ser. No. 569,953 and is not explained here in detail.

Said data transfer system is as explained below. o Operation part CPU (the option codes 000, 001, 010 are assigned to the operation part CPU)

(1) Send data

| | | | | No. of reserved documents | | | | | | | | Reserved size code | | | |
|---|---|---|---|---|---|---|---|---|---|---|---|---|---|---|---|
| P | 0 | 0 | 0 | $D_{11}$ | $D_{10}$ | $D_9$ | $D_8$ | $D_7$ | $D_6$ | $D_5$ | $D_4$ | $D_3$ | $D_2$ | $D_1$ | $D_0$ |
| | | | | 0 | 0 | 1 | 0 | 0 | 0 | 0 | 0 | 0 | 0 | 0 | 1 |

(Example) Size A4, 3rd stage 20 sheets, 15 copies

-continued

| | | | | | | | | | | | | | | | |
|---|---|---|---|---|---|---|---|---|---|---|---|---|---|---|---|
| | | | | 0 | 0 | 1 | 1 | 0 | 0 | 0 | 1 | 0 | 1 | 0 | 1 |
| P | 0 | 0 | 1 | $D_{11}$ | $D_{10}$ | $D_9$ | $D_8$ | $D_7$ | $D_6$ | $D_5$ | $D_4$ | $D_3$ | $D_2$ | $D_1$ | $D_0$ |

No. of stages No. of copies (2) Receive data

No. of remaining documents under the copying Size code

| | | | | | | | | | | | | | | | |
|---|---|---|---|---|---|---|---|---|---|---|---|---|---|---|---|
| P | 0 | 0 | 0 | 0 | 0 | 0 | 1 | 0 | 1 | 0 | 1 | 0 | 0 | 1 | 0 |

No. of stages No. of remaining copies

| | | | | | | | | | | | | | | | |
|---|---|---|---|---|---|---|---|---|---|---|---|---|---|---|---|
| P | 0 | 0 | 1 | $D_{11}$ | | | | $D_7$ | | | | $D_3$ | | | |
| | | | | 0 | 0 | 1 | 1 | 0 | 0 | 0 | 0 | 0 | 0 | 1 | 0 |

(Example) 2nd stage, 2 copies, 1st and 4th stages empty, busy condition

| | | | | | | | | | | | | | | | |
|---|---|---|---|---|---|---|---|---|---|---|---|---|---|---|---|
| | | | | | | | 1 | 0 | 0 | 1 | 0 | 0 | 1 | 1 | 0 |
| P | 0 | 1 | 0 | | | | $D_8$ | $D_7$ | $D_6$ | $D_5$ | $D_4$ | $D_3$ | $D_2$ | $D_1$ | $D_0$ |
| | | | | | | | | d | c | b | a | d | c | b | a |

Busy Switch 209 Switch 109

(Note) a, b, c, d are switches of 1~4 stages.

ADF CPU (option codes 011, 100 are assigned to the ADF CPU)

(1) Send data

Print signal

| | | | | | | | | | | | | | | | |
|---|---|---|---|---|---|---|---|---|---|---|---|---|---|---|---|
| P | 0 | 1 | 1 | $D_{11}$ | $D_{10}$ | $D_9$ | $D_8$ | $D_7$ | $D_6$ | $D_5$ | $D_4$ | $D_3$ | $D_2$ | $D_1$ | $D_0$ |
| | | | | | | | | 0 | 0 | 1 | 0 | 0 | 1 | 1 | 0 |

(2) Receive data (Example) 1st and 4th stages empty, during copying of 2nd stage

| | | | | | | | | | | | | | | | |
|---|---|---|---|---|---|---|---|---|---|---|---|---|---|---|---|
| | | | | | | | | | | | 0 | 0 | 0 | 1 | 0 |
| P | 0 | 1 | 1 | $D_{11}$ | | | | $D_7$ | $D_6$ | $D_5$ | $D_4$ | $D_3$ | $D_2$ | $D_1$ | $D_0$ |

Busy Designation of no. of stages
Document supply signal
Print (copy) end signal

| | | | | | | |
|---|---|---|---|---|---|---|
| P | 1 | 0 | 0 | | $D_7$ | $D_3$ |

No. of copies

In above example, there is no document in the 1st and 4th stages, copying is carried out for the documents in the 2nd stage with remaining documents of 15 sheets, each document is required to copy of 2 sheets, and the copying operation for 15 sheets in each of 20 documents in the size A4 is reserved for the 3rd stage.

Explanation is developed for the operation part CPU (80) with respect to the flow charts of FIG. 9A to FIG. 9F, regarding the processing for reservation data. First, when the power is supplied to the operation part CPU (80), it is initialized (step S1) and thereby the memory and display digit counter are cleared out.

Figure 10:
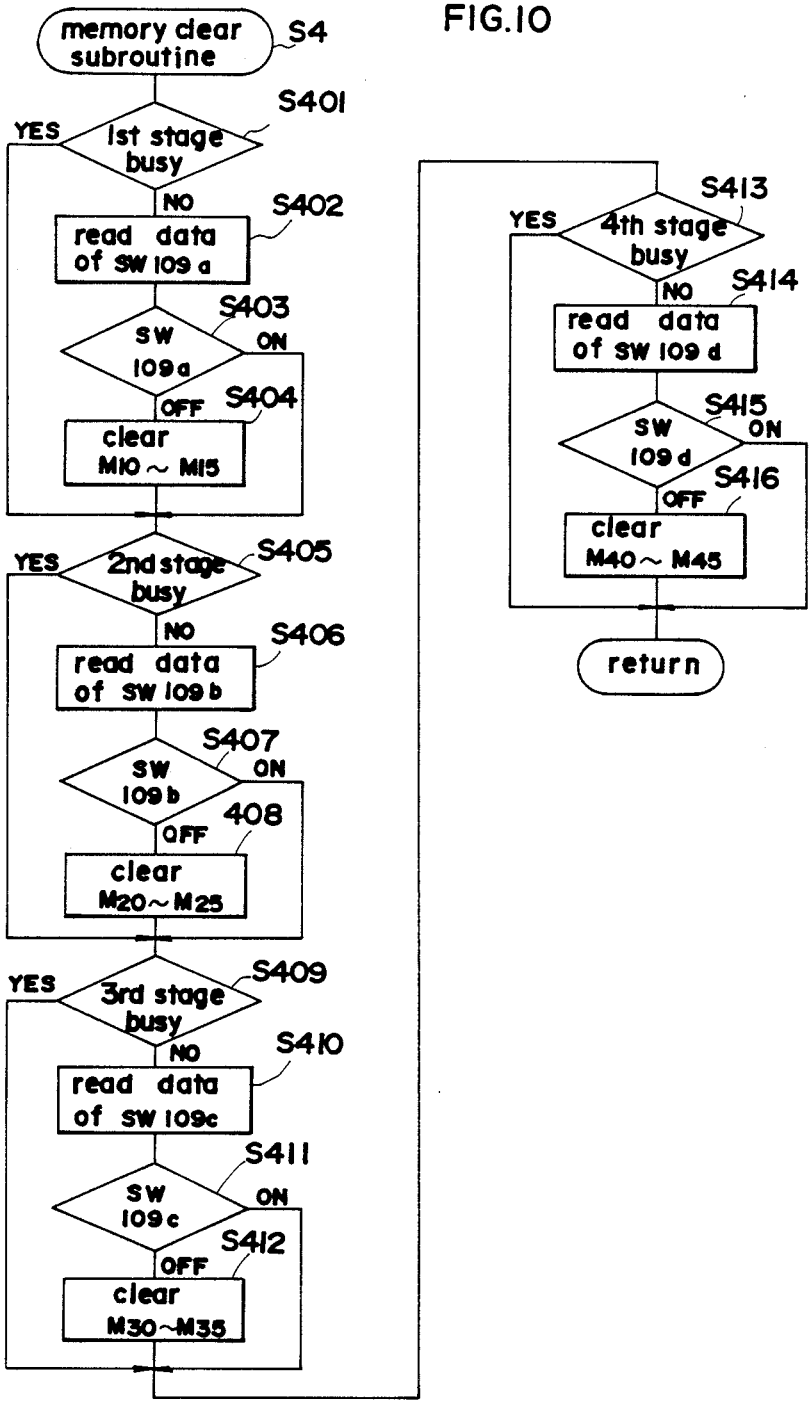
FIG. 10 is a detailed flowchart showing an operation of a memory clear subroutine.

After the lapse of time enough for the CPU to make communication (about several tens msec) (step S2), data for indicating existence or no existence of documents in each stage is received from the ADF CPU (82) and the data of copying condition is received from the copying machine CPU (81) (Step S3), and the reservation memory of document tray of the empty stage is cleared out from such data (Step S4). A detailed flow chart of step S4 is shown in FIG. 10 and it is explained hereunder.

In the step S401, it is judged whether the copying of document tray (100) of the 1st stage is being executed (BUSY) or not. When busy, processing proceeds to the step S405. When not busy, the data of switch (109*a*) which detects documents in the document tray (100) is fetched from the communication data in the step S402, and the condition of switch (109*a*) is judged in the step S403. If the switch (109*a*) is OFF, namely there is no document on the document tray (100), the reservation memory area of the 1st stage is cleared out in the step S404. For the reservation of document trays (200), (300), (400) in the 2nd to 4th stages, the memory clear processings are executed as explained above in the steps S405~S416.

In the step S5, the display window of operation panel displays in orange, blue or green colors the condition of document trays of each stage. Details of this processing is shown in the flow chart of FIG. 11 and it is explained subsequently.

In the step S501, a counter n is set to 1. This counter n is used for repeating the following processing after the step S502 up to 4 times. A count value of counter n corresponds to a number of stages of document trays.

For example, when n=1, it is judged, in the step S502, whether there is a reservation flag at the 1st stage to be set when the copying condition for the document tray of the 1st stage is reserved. When the reservation flag is set, the sets a display window (161*a*) of the 1st stage displays in orange indicating the reservation is already set in the step S603 and "1" is added to the counter value in the step S504.

If the reservation flag is not set, it is judged whether the copying to the document tray (100) of the 1st stage is being carried out (BUSY) in the step S505. If judged that it is not busy and there is the data of number of copies of the 1st stage in the step S506, the display window (161*a*) displays blue, indicating that the reserved copying has been completed in the step S507.

When not busy and there is no data of number of copies, condition of switch (109*a*) is judged in the step S508. In case the switch (109*a*) is OFF, namely there is no document, the display windown (161*a*) displays green, indicating that there is no document in the step S509.

In the step S510, it is judged whether a value of counter n is "4" or not. When it is not 4, processing returns to the step S502. When the value is 4, this subroutine is completed.

Judgement for numeral key input

Figure 9A:
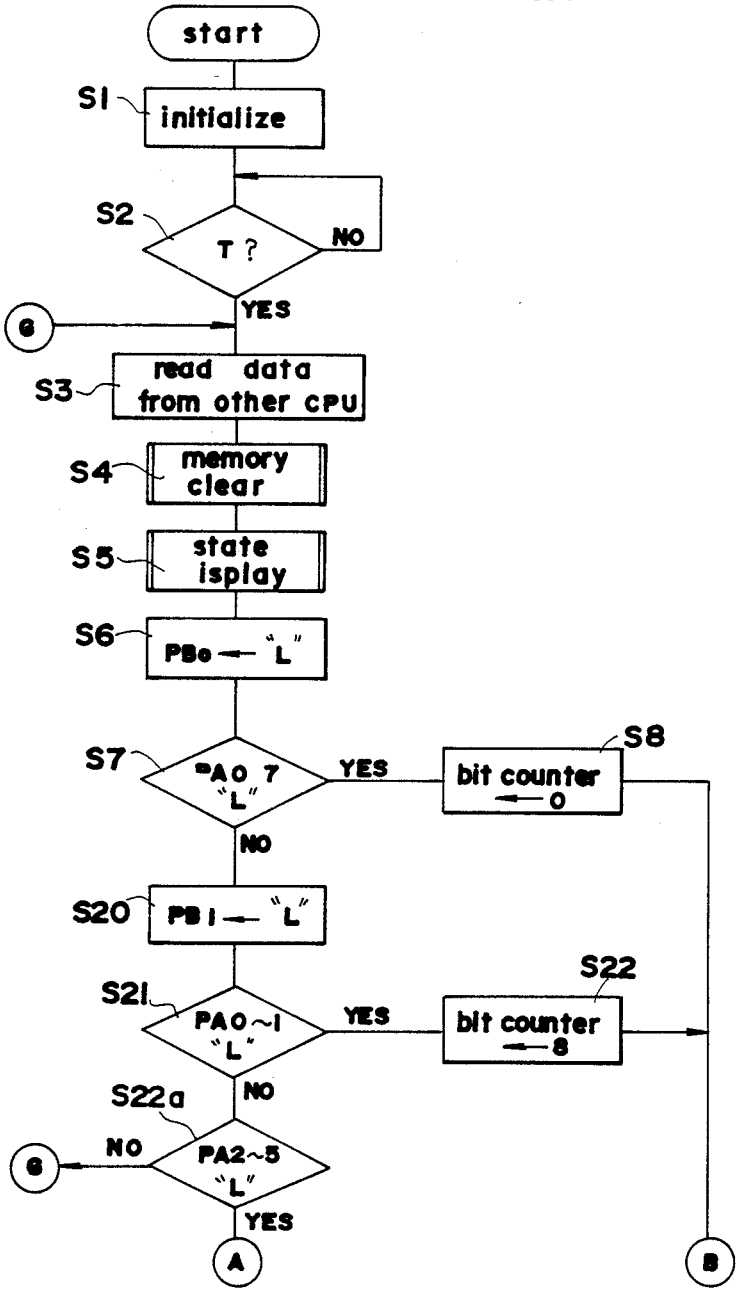
FIGS. 9 through 9F are flowcharts of steps for presetting copying conditions.

Returning to the step S6 of FIG. 9A, "L" is output to the "0"th bit of PB port of the IO (86) from the initial mode, 8 bits indicating the state of PA port is fetched, it is judged whether any bit has become "L" or not in the step S7. When any of bits becomes "L", it is judged if there is an input by keying. Here, the processing proceeds to the steps after the step S8 and it is judged which bit has become "L" by the bit counter.

For example, "3" is keyed in, the status signal of the PA port is indicated as follow.

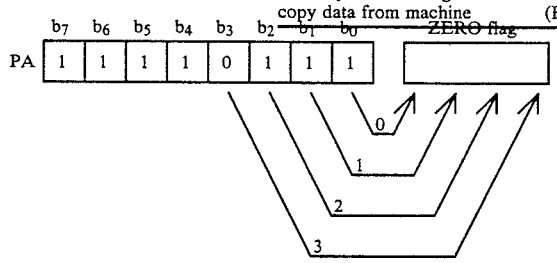

This status signal is fetched to the accumulator (Acc) (Step S9). This signal is sequentially shifted to the right. At the 3rd (counter value) from 0, a zero flag rises (Step S12)1. When a counter value is less than 3, the counter moves to the succeeding routines and verifies the number of digits with the counter of display digit (Steps 13, 14). If digit counter is not 1, a value "3" which is a value of a bit counter is stored in the 1st digit display register in the RAM (83) as an input of the 1st digit by keying (Step S16) and 1 is added to the digit counter (Step S17).

Thereafter, display data and digit data are sent to the second display controller (87) and it is then displayed on the display (170) (Steps S18, 19). For the numerals "8" and "9", as is shown in the flow chart, "L" is output from the IO controller PBI port (Step S20) in order to search the condition of PA port (Step S21), when either is "L", a bit counter is set to 8 in the step S22. Thereby, the input by ten keys can be detected. In the case of two digits input, after a value of the first keying is transferred in the step S 15 to the display register for the 2n digit, the numeral keyed in later is stored in the display register for the 1st digit. In this example, input of three or more digits in the step S13 is inhibited.

The function keys can be checked as follow. The condition of PA 2~5 ports of IO controller is searched (Step S22*a*) in order to judge which key of F0~F3 is depressed (Step S23~S26) and as shown in the following table, the numerals of the display register input previously, is transferred to the memory areas M0~M3 in accordance with the key depressed and is stored therein (Steps S27~S29, S30*a*).

F0 Size code: Memory area M0
F1 No. of copies: M1
F2 No. of sheets: M2
F3 No. of stages (ADF): M3

When the function key F0~F3 is depressed, the digit counter and display register are cleared out in the Step S30.

Display method

Figure 9B:
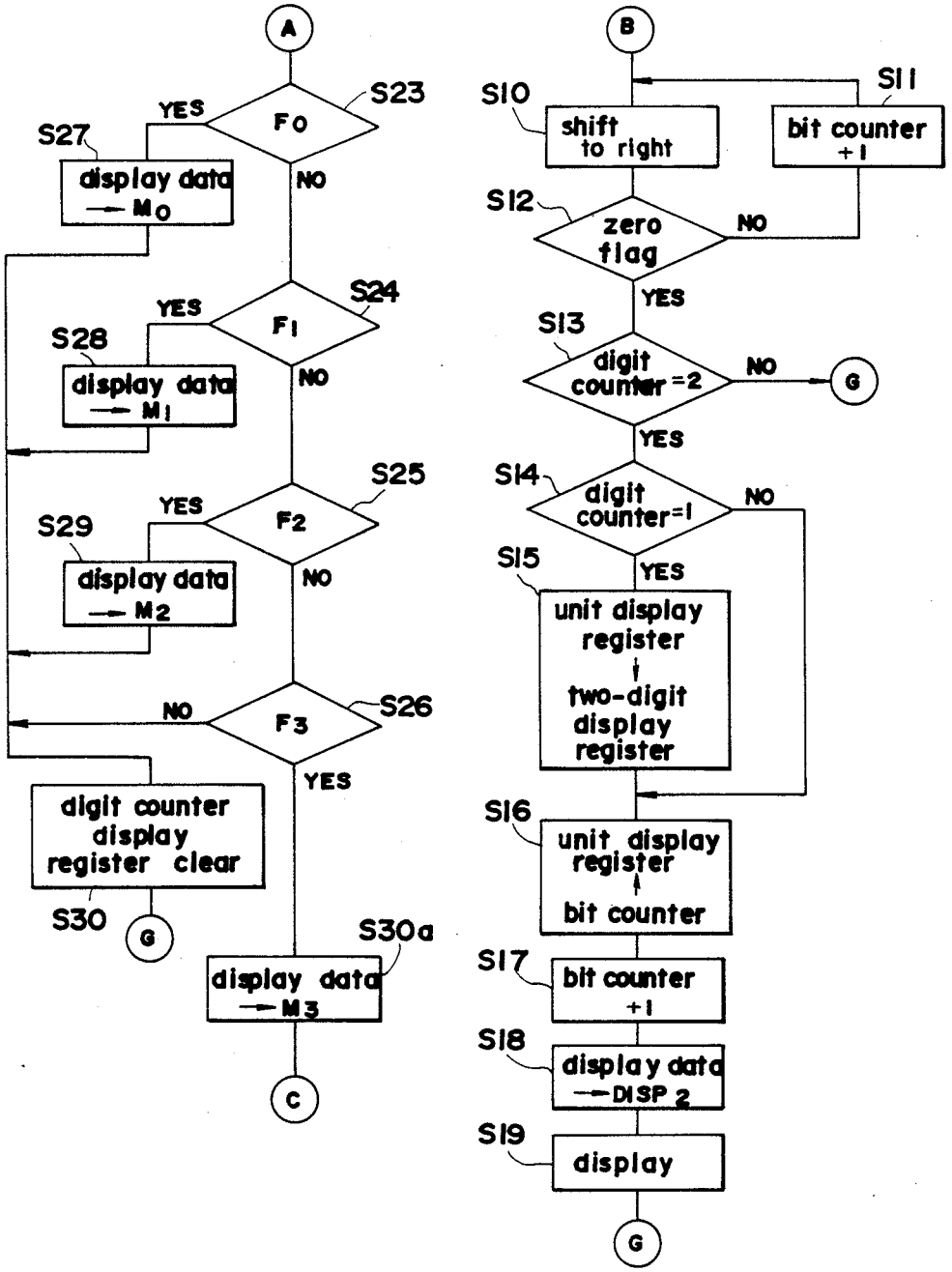
Figure 9C:
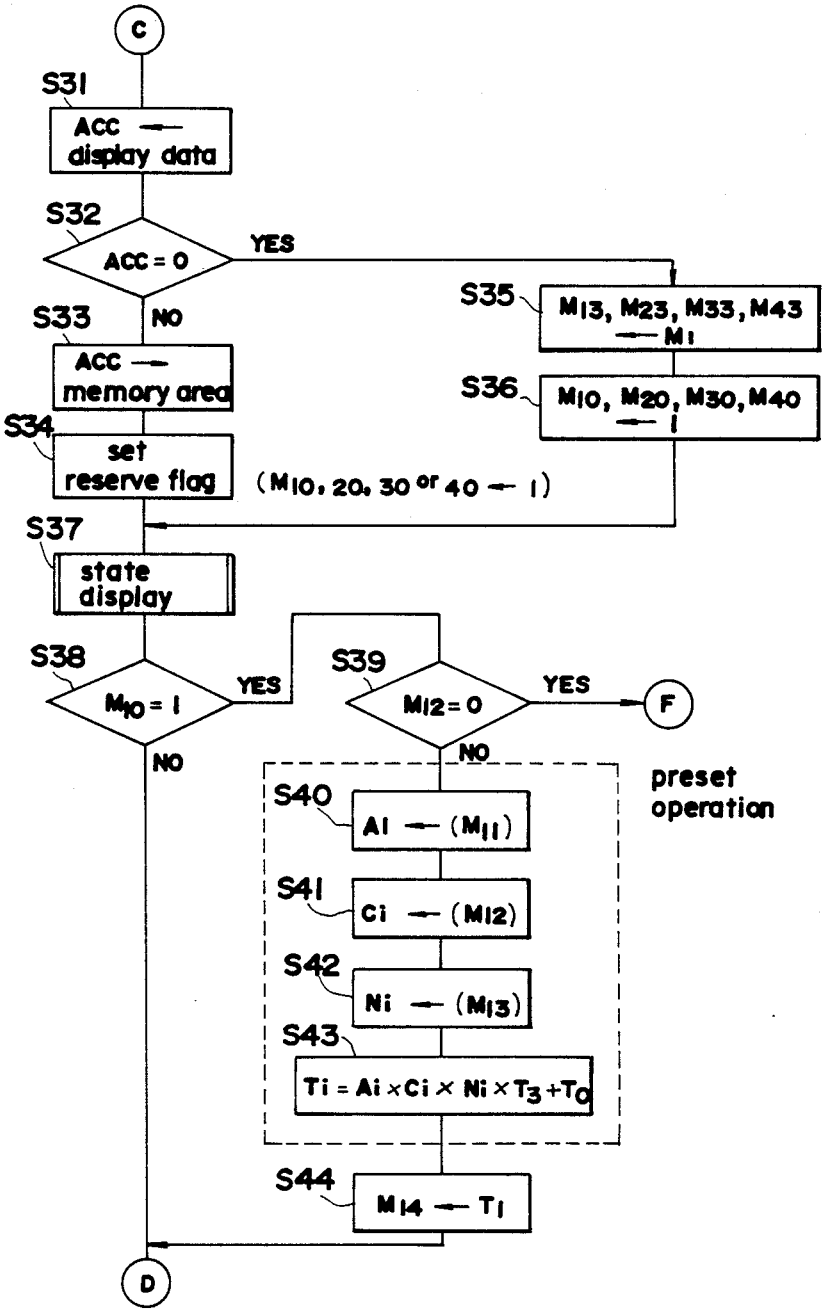
Figure 9D:
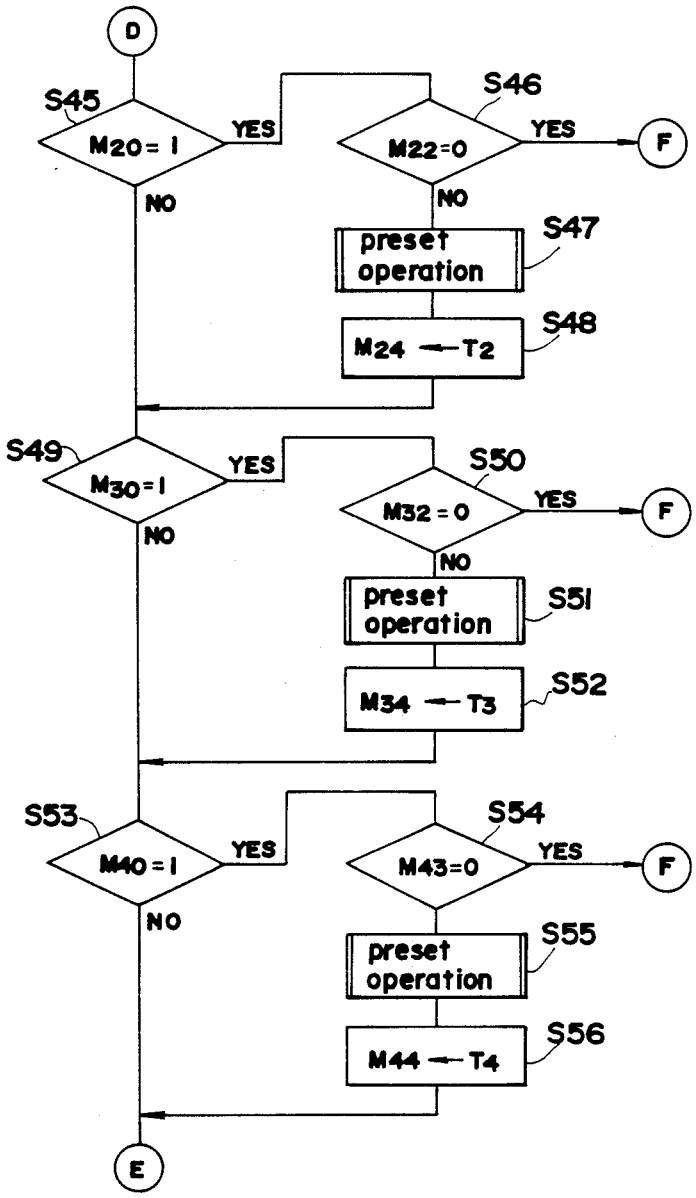
Figure 9E:
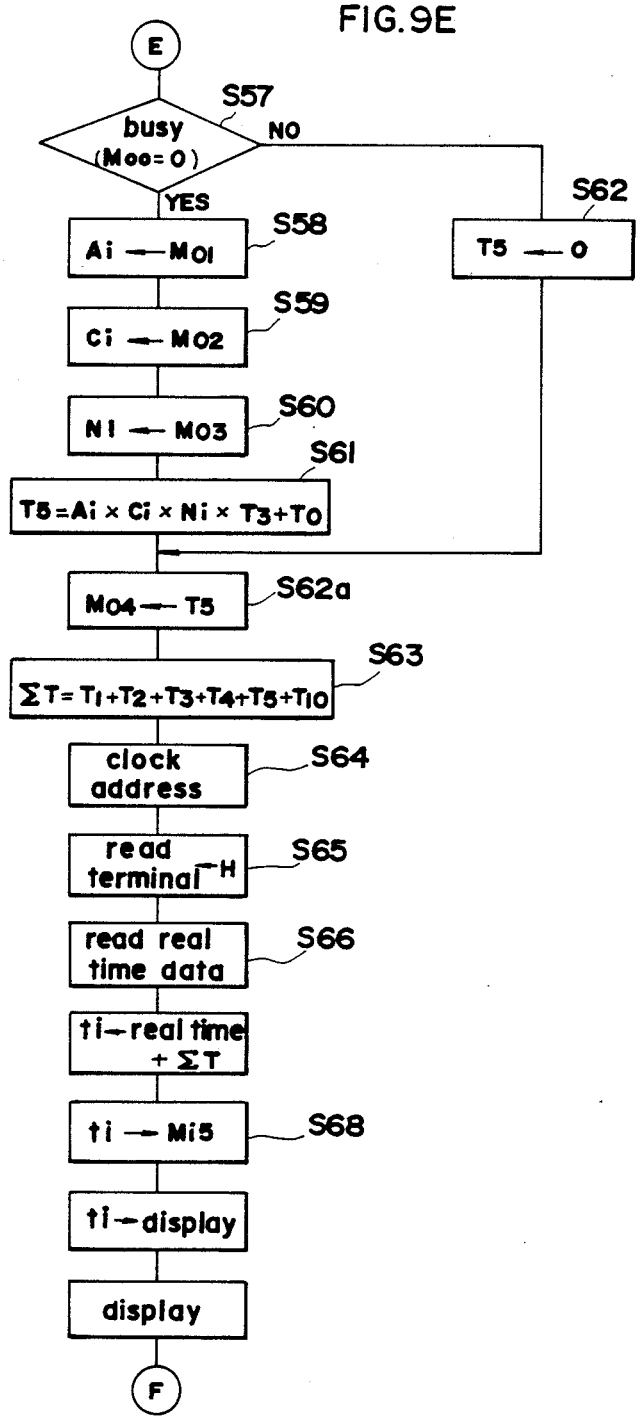
Figure 9F:
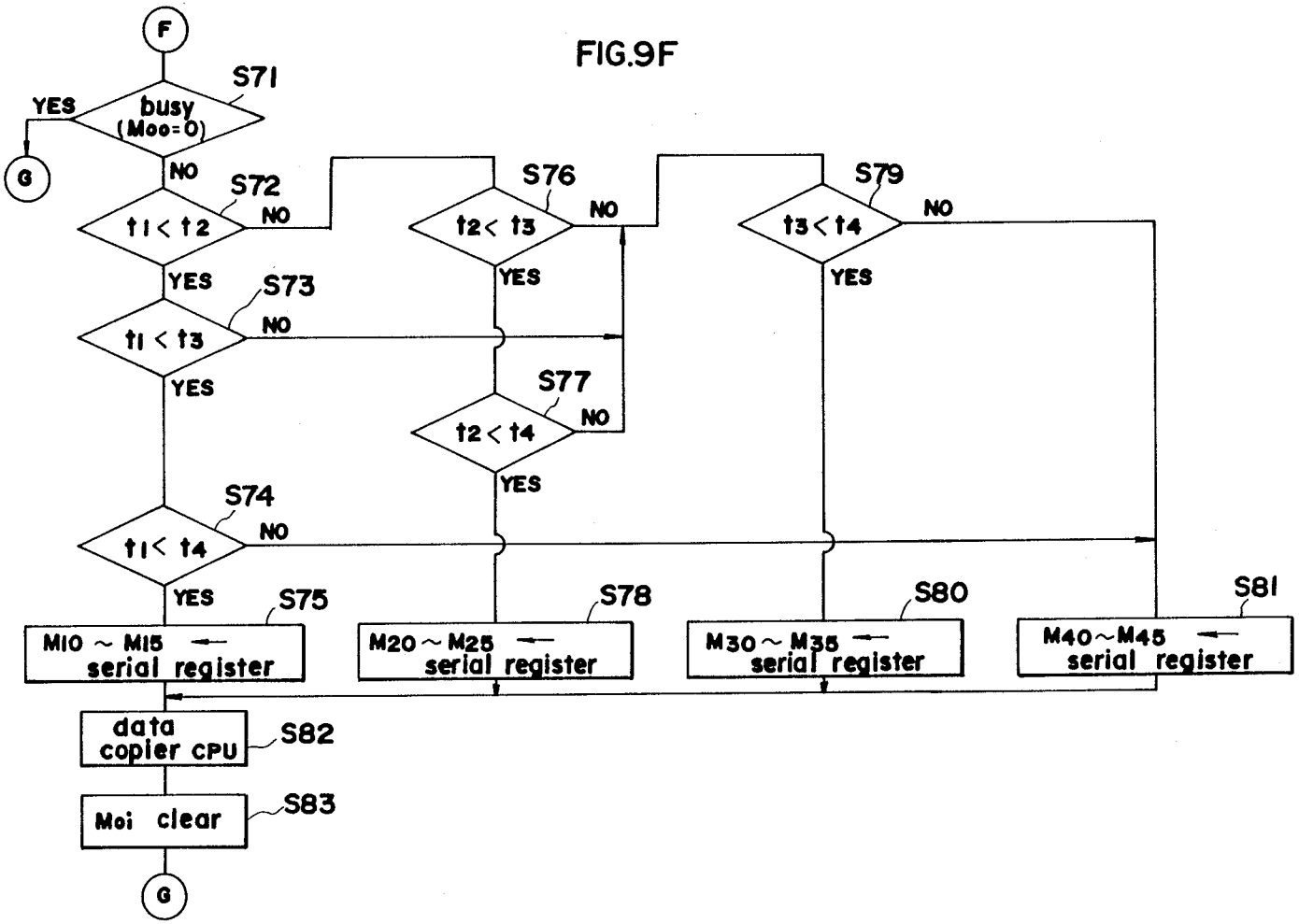

As shown in FIG. 9B and FIG. 9C, when the function key $F_3$ is depressed, it is considered that a series of operations for reservation have been completed. Thereby, a display data is read to the accumulator in the Step S31, it is judged whether this data is "0" or not in the step S32. When it is not "0", data is stored in the memory area as indicated below for reservation, predetermined in accordance with a number of stages of $M_3$ in the step S33 and the reservation flag is set in the step S34.

| | Reservation flag | Size | No. of sheets | No. of copies | Required time | End |
|---|---|---|---|---|---|---|
| 1st stage | M10 | M11 | M12 | M13 | M14 | M15 |
| 2nd stage | M20 | M21 | M22 | M23 | M24 | M25 |
| 3rd stage | M30 | M31 | M32 | M33 | M34 | M35 |
| 4th stage | M40 | M41 | M42 | M43 | M44 | M45 |
| Memory of remaining copy data from machine | M00 (Busy) | M01 | M02 | M03 | M04 | M05 |

In accordance with the contents of reservation, calculation for reservation is carried out.

Figure 11:
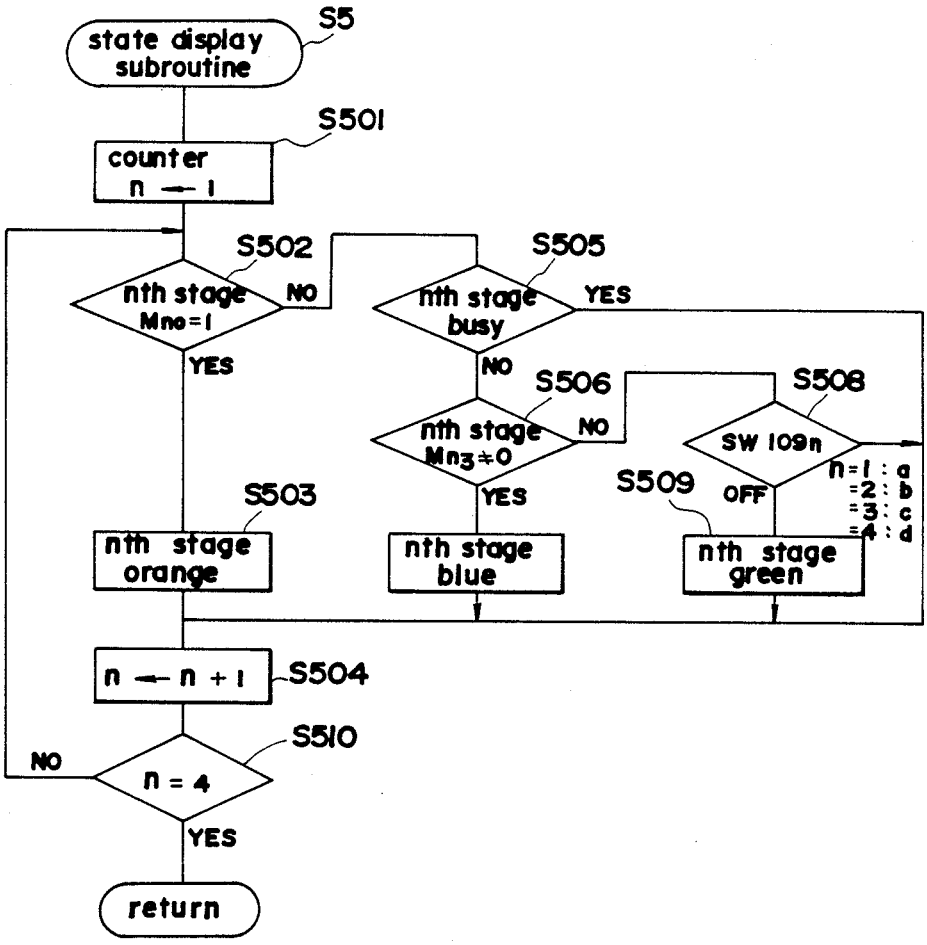
FIG. 11 is a detailed flowchart showing an operation of a display subroutine.

Meanwhile, when display data is 0 in the step S32, the number of copies data M1 is transferred to the number of copies reservation memory areas M13~M43 of each stage and the reservation flags $M_{10}$, $M_{20}$, $M_{30}$, $M_{40}$ of each stage are given in the step S36. Therefore, the same number of copies data is entered to the memory areas $M_{13}$~$M_{43}$ and each stage is reserved. In the step S37, the subroutine for status display shown in FIG. 11 is called and the display window (161) displays in various colors in accordance with the status of each stage.

Calculation of reservation time

Judging whether the reservation flag is given or not to the reservation memory of the first stage in the step S38, it is judged, when such reservation flag is given, whether the number of sheets of document data is stored or not in the memory area M10 in the step S39. In case a number of sheets of data is stored in the memory area M10, the processing time T1 is calculated in the steps S40~S43 by adding the time Ts required for copying a sheet of paper preset from the speed constant Ai based on the size of copying paper, number of sheets of documents Ci, number of copies Ni and performance of the copying machine, a time required by the document to move on the document tray and the time required for copying other than the time Ts, namely the time To required by the document to be discharged to the document tray such as transfer of document, and such processing time T1 is stored in the memory area M14. As in the case of the processing for reservation memory of single stage mentioned above, the processing times T2~T4 are calculated also for the reservation memory of 2 to 4 stages. Based on the data from the copying machine CPU (81), it is judged whether a copying operation is being executed (busy) or not in the step S57. When busy, the remaining processing time is calculated in the steps S58~S60. When not busy, the remaining processing time is set to "0" in the step S62. Upon completion of all calculations, such processing times are all added in the step S63 in order to obtain the total time ΣT.

Next, the current time can be read by giving an address of CLOCK to the IC for clock in the step S64 from the IO controller PD port and setting the READ terminal to "H" in the step S65 and then a current time data is fetched (in the manner as O:Δ) by the operation part CPU in the step S66. The reserved end time of copying operation is calculated by adding ΣT to the current time in the step S67. The calculation result data (value of time O:x) is stored in the end time memory areas $M_{15}$~$M_{45}$ of each stage in the step S68 meanwhile, it is transferred to the controller (87) in the step S69 and the forecasted time displayed in the step S70.

Next, it is judged whether the copying machine is now under the copying process or not from the "Busy" signal in the communication data between the CPU's described above in the step S71. When not busy, the smallest end time among $t_1$~$t_4$ (scheduled) is selected from the reservation memory in the steps S72~S83 and these copying data blocks are transferred on said communication data, the reservation flag is cleared out and processing is then returned to the initial routine for repeating the operations mentioned above.

Figure 12:
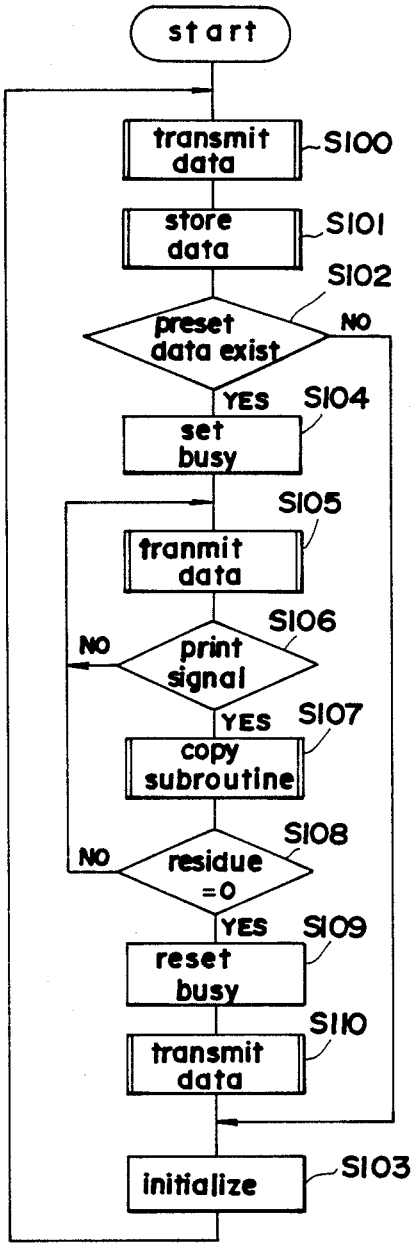
FIG. 12 is a flowchart of steps for transferring data.

On the other hand, as shown in the flow chart of FIG. 12, the copying machine CPU (81) transfers the data. The copying machine CPU (81) sends its own data to the operation part CPU (80), ADF CPU (82) in the step S100 and each data is received in the RAM (84) in the step S101. In the step S102, it is judged whether there is reserved data or not in the data sent from the operation part CPU (80). When not found, the copying machine is initialized in the step S103 and data is transferred. Thereby, processing enters the same routine as explained above, waiting for the reservation data. When there is the reserved data, the busy state is set in the step S104 and an new data is generated to the operation part CPU (80). When the print signal enters from the ADF CPU (82) in the step S106, copying process starts in the step S107 and is continued while executing the data transfer until the end of copying for their reserved number of sheets. When the remaining number of copies becomes zero in the step S108, the busy state is reset in the step S109 and the processing returns to the initial routine.

In such a structure, when an operator reserves a program as explained above by placing the documents on the document tray of multistages, the job display window (161) changes the display in the colors from green to orange. The copying machine displays the time of completing the copying process reserved by the program from the reserved program registered in the internal memory and the copying speed. For example, display is carried out shown in FIG. 7 (10:25 in FIG. 7).

Figure 13:
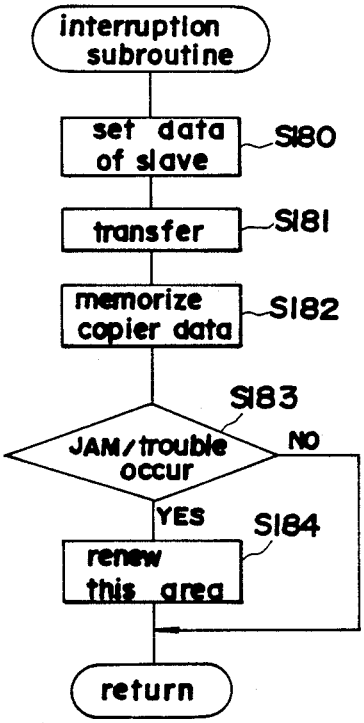
FIG. 13 is a flowchart of steps of interrupt operation.

FIG. 13 shows the processing of the slave side CPU, namely the operation part CPU (80) and ADF CPU (82) when an interrupt is issued from the copying machine CPU (81).

When an interrupt is issued, the data to be sent in the step S180 is set to the serial transfer register (not illustrated), the serial data is sent and received simultaneously in synchronization with the clock transmitted from the CPU (81) in the step S181. Upon completion of sending and receiving, the data sent from the copying machine side in the step S182 is stored in the memory. In case the JAM/trouble data is included in the data received in the step S183, content in the pertinent memory area is updated in the step S184, completing the interrupt processing.

In case any JAM/trouble is not generated, the interrupt processing is completed without any additional processings.

Regarding document supply, operations of ADF CPU (82) are explained with respect to the flow chart shown in FIG. 14A~FIG. 14D.

First, the sending data transmitted from the copying machine CPU is received, designation of number of stages is judged in the step S200. When it is designated, the document tray of the stage designated is shifted to the predetermined location. Hereinafter, explanation is developed for the case where the stage is designated to the 1st stage but the operations are substantially the same even in case another stage is designated. When a number of stages are designated and number of copies are sent to the ADF CPU, existence or not existence of a document on the tray is detected by the switch (109*a*) of the designated document tray (100). In case the copying machine is busy in the step S202, the supply print routines in the steps S202 and the succeeding steps start. The supply part has the three modes of A, B and C. In the mode A, the documents are supplied from the document tray (100) and is discharged to the intermediate tray (500). In the mode B, a document is supplied from the intermediate tray (500) and is discharged to the document tray (100). In the mode C, a stack of documents is supplied at a time to the document tray from the intermediate tray (500). Each mode can be summarized in the following table.

| | Tray 100 | Tray 500 | Motor 140 | Motor 153 | Motor 240 | SL125 | SL225 |
|---|---|---|---|---|---|---|---|
| Mode A | Paper supply | Paper discharge | CCW | CCW | CCW | OFF | ON |
| Mode B | Paper discharge | Paper supply | CW | CW | CW | ON | OFF |
| Mode C | Paper | Paper | CW | CCW | CW | ON | OFF |

-continued

| Tray 100 | Tray 500 | Motor 140 | Motor 153 | Motor 240 | SL125 | SL225 |
|---|---|---|---|---|---|---|
| discharge | supply | | | | | |

Figure 14A:
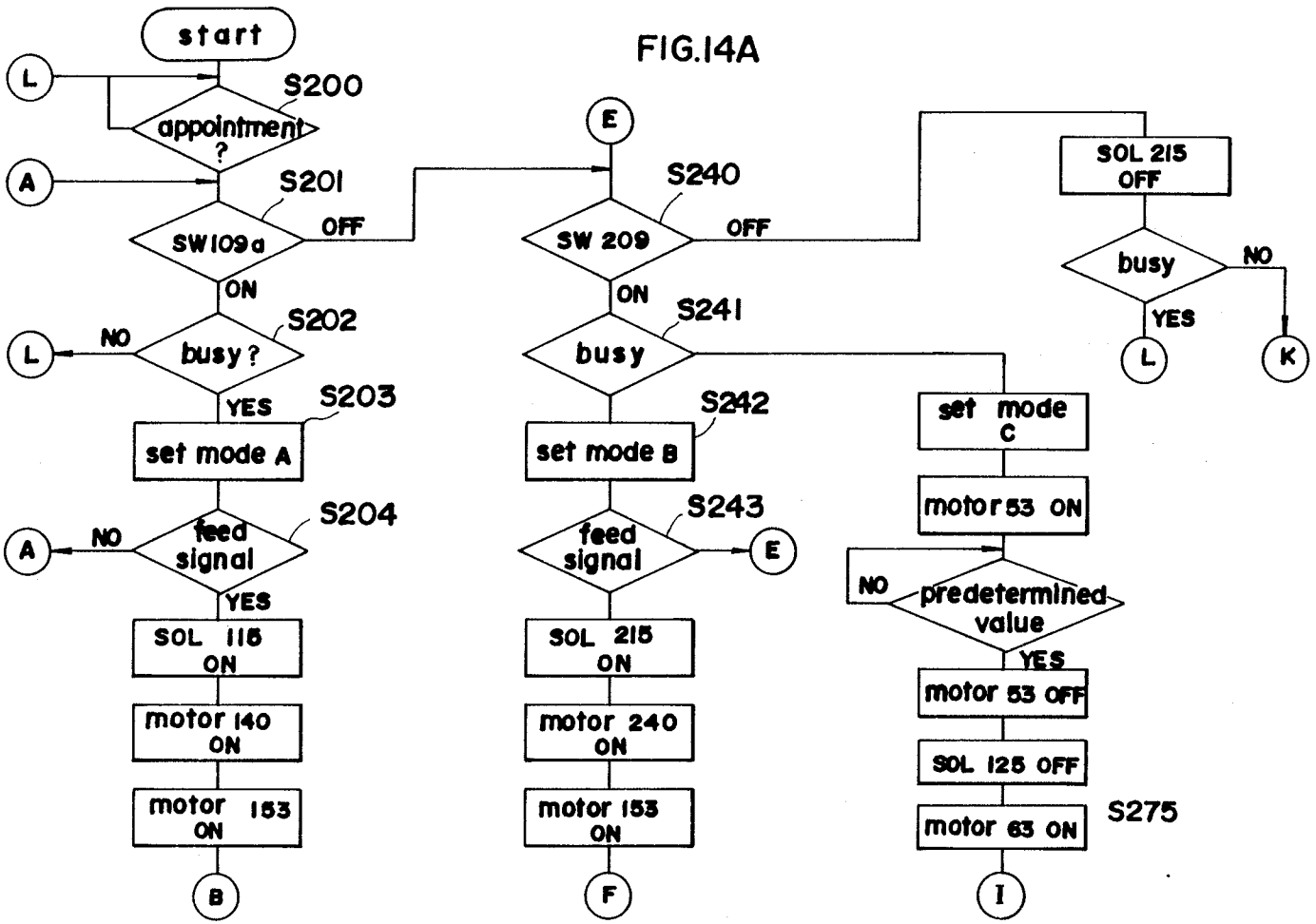
FIGS. 14A through 14D are detailed flowcharts of steps of copying operation.
Figure 14B:
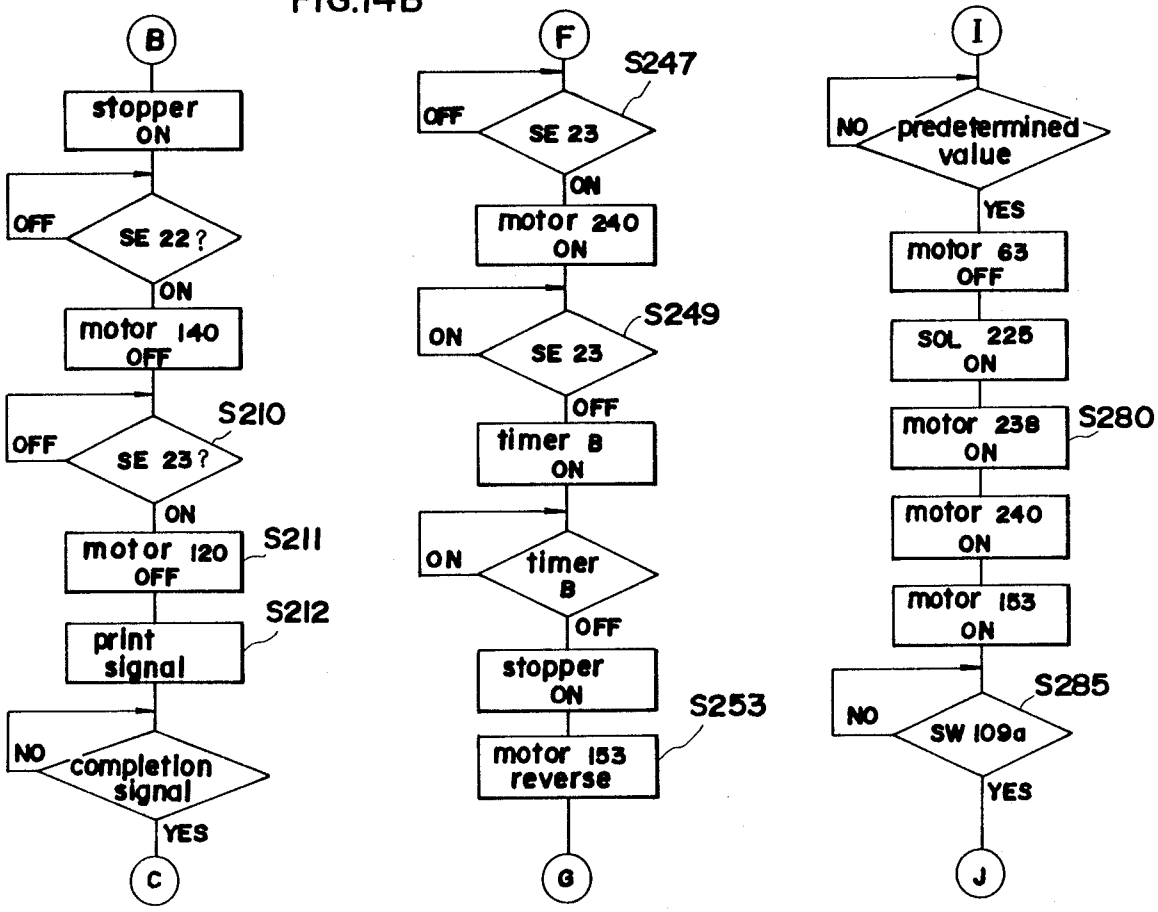
Figure 14C:
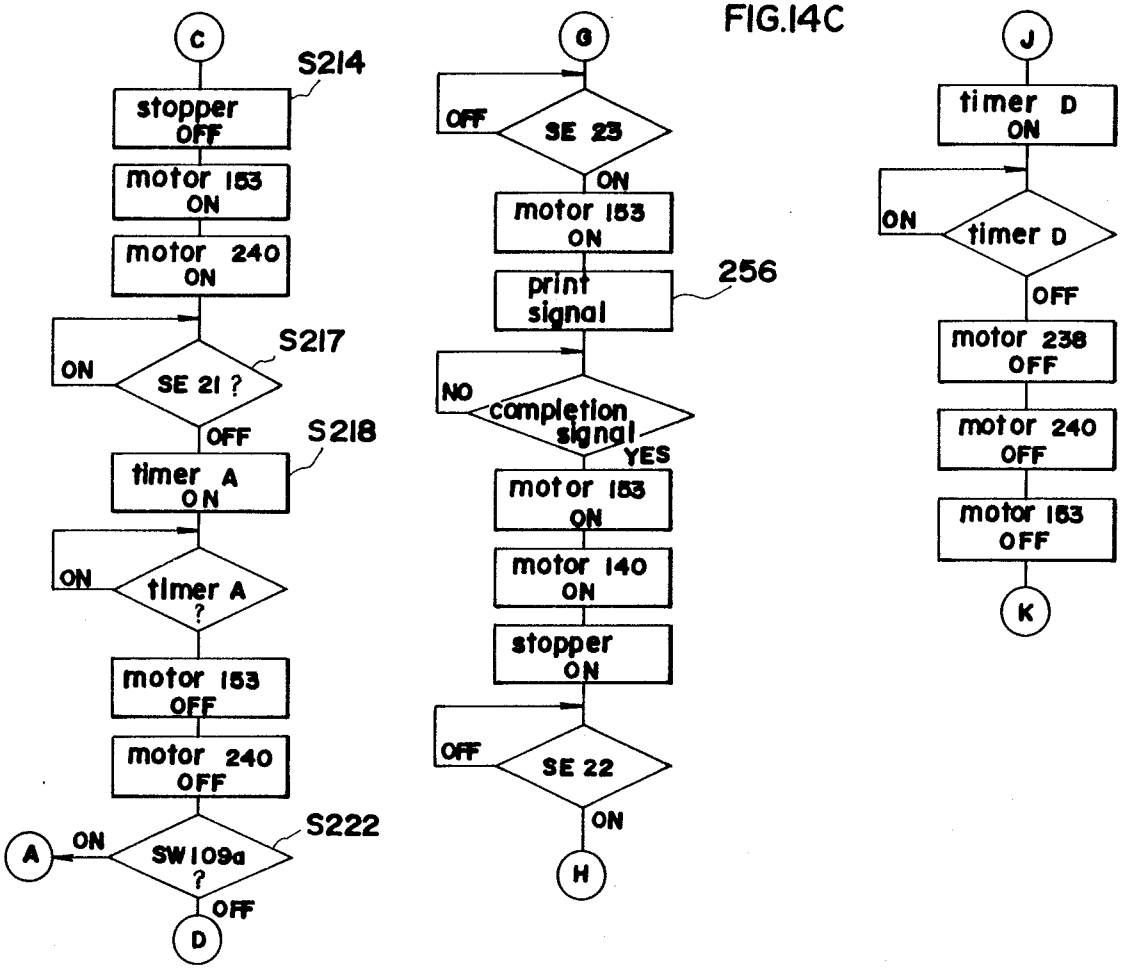
Figure 14D:
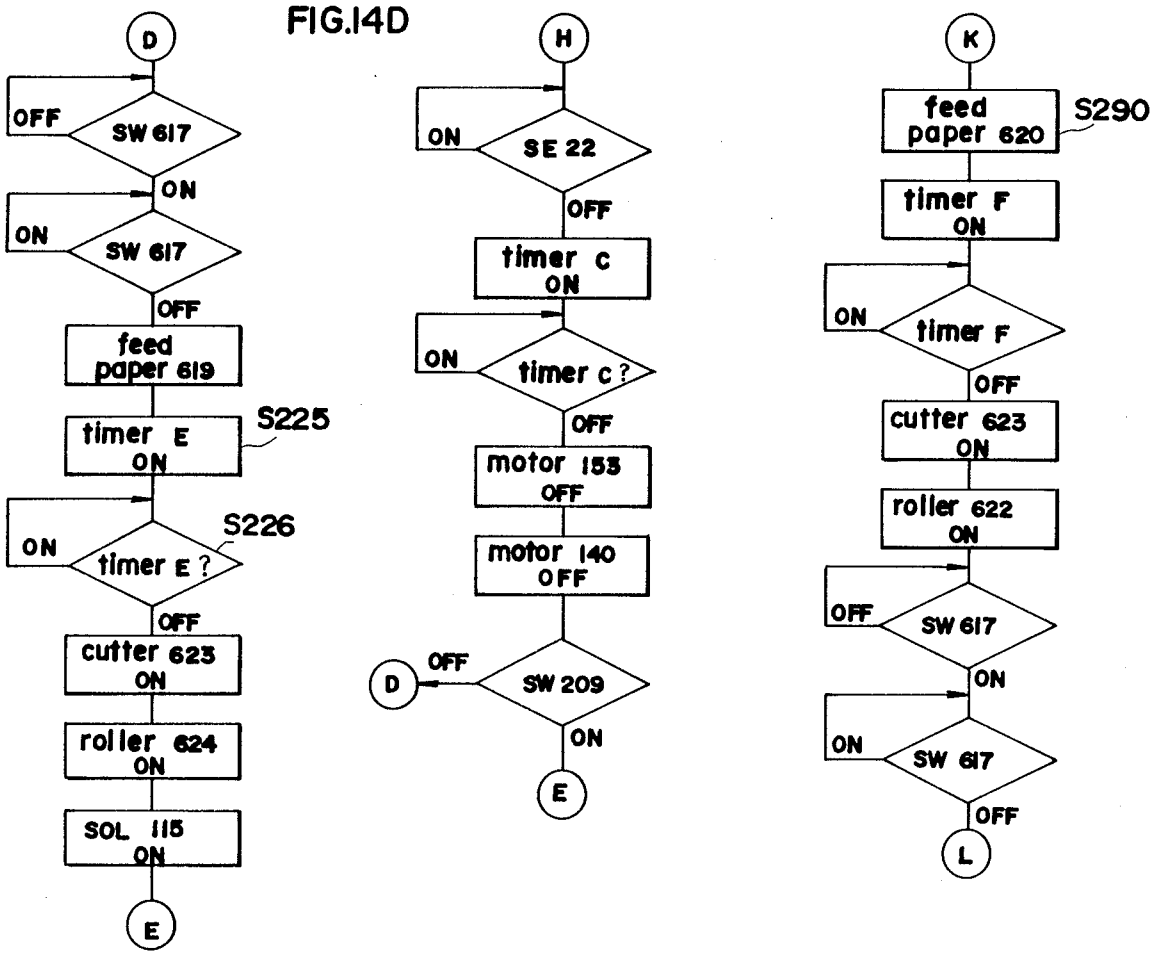

In the flow chart of FIG. 14A, it is judged whether there is a document in the document tray (100) or in the intermediate tray (500) or not (Steps S201, S240). In accordance with the result of such judgement, the mode A or B is set and moreover in case there is a document in the document tray (100) and it is judged whether the machine is busy or not. When the machine is busy, the mode C is set.

In case the document exists in the tray 100, the switch 109*a* turns ON, the mode A is set in the step S203, waiting for the paper supply signal sent from the copying machine. (Step S204) When the paper supply signal appears, the rotary solenoid (115) turns ON, resulting in the conditions shown in FIG. 4, FIG. 5 and FIG. 6. In this case, the paper supply motor (140) rotates and the belt transfer motor (153) also turns ON and rotates, causing the stopper (21) to turn ON. When the lowest document is sent by the supply roller (110) and passes a pair of rollers (150), (151) under the prevention of double sending by the handling roller (130), the sensor (22) turns ON (Step S208), the motor (140) turns OFF, and the paper supply roller (11) is stopped but the document sent out is further sent by the rollers (150) (151) and belt (25). When the sensor (21) turns ON (Step S210), the motor (153) turns OFF (Step S211), the document is stopped by the stopper (21), the print signal is issued to the copying machine (Step S212) and it is expected that the copying end signal is transmitted from the copying machine. When the end signal appears, the stopper (21) turns OFF (Step S214), the motors (153) and (240) turn ON, the rollers (250), (251) and (220) rotate discharging the document to the tray (500). When the document passes the sensor (23) (Step S217), the timer A turns ON for a time period sufficient enough for discharging the entire part of document to the tray 500 (Step S218). When this timer A turns OFF, the belt transfer motors (153), (240) turn OFF, followed by waiting for a supply of the paper supply signal. Here, the switch (209) turns ON but there is no change of operation under this condition and such operations are repeated until all documents are discharged from the tray (100). When all documents in the tray (100) are exhausted, it means the end of a sheet of copy of each document and the switch (109*a*) turns OFF (Step S222).

When the final copying turns ON and OFF the discharge switch (617) of the copying machine, the first rolled marker paper (619) is sent by a pair of pinch rollers (621), it is cut in the adequate length by a cutter (623), discharged to the roller (624) and is placed on the final copying paper. The length of the marker paper is determined by a timer E (Step S225, S226).

Thereby, separation from the copying for the second sheet is carried out and the discharge switch (617) is turned ON and OFF by the marker paper having been cut. As a result, processing enters the routine of copying operation for the second sheet. When the switch (209) turns ON (Step S240) and the machine is busy (Step S241), the operation mode is set to the mode B (Step S242) (motor rotation is set in the reverse direction to the direction A), the rotary solenoid (115) turns OFF, the handling roller (130) is pushed up by the cam slope (112*a*). When the paper supply signals appears under this condition (Step S243), the rotary solenoid (215) turns ON as shown in FIG. 3, the paper supply motor (240) and belt transfer motor (153) turns ON supplying the paper. The sensor (23) then turns ON (Step S247) and then turns OFF in the step S249 (namely, the document passes the sensor). After a certain constant period (end of timer B), the stopper (21) turns ON and the belt transfer motor (153) reversely rotates (Step S253). When the document newly turns ON the sensor (23), the belt transfer motor (153) turns OFF and the document halts at the stopper position. In the step S256, the print signal is issued and the motors (140), (153) turn ON with the print end signal. Thereby the document is discharged to the tray 2, turning OFF the switch (209). Namely, this processing is repeated until the final document in the document tray (500) is discharged and moreover copying for the required number of sheets, for example, for the third and fourth sheets is carried out. When the copying for the required number of sheets is completed, the busy state is reset by the copying machine CPU (81) (Step S109 in FIG. 12). But if the busy state is reset under the condition that the document group is housed in the side tray (100) (Step S202), the processing mode returns to the START, followed by waiting of the next designation.

Meanwhile, when the busy state is reset under the condition that the document is to remain in the tray (500), the operation enters the mode C (Step S270). The stepping motor (53) turns on at the third position where a lump of documents on the tray (500) is discharged at a time and the tray (100) stops to move, turning ON the solenoid (125). Thereby the document being pressed is restored. The tray (500) also causes the stepping motor (63) to rotate and stops to move at the third position (Step S275). Thus the solenoid (225) turns ON and restores. Next, the motors (238) (240) (153) turn ON (Step S280) and the documents on the tray (500) are collected at a time on the tray (100). When the documents move to the tray (100), the detection switch (109*a*) on the tray turns ON, and the motors (238) (240) and (153) turn OFF (Step S285), thus completing the copying operation.

Next, in the step S290 the second marker paper (620) passes the roller (622), is cut by the cutter (623) and is sent by the roller (624) and is then place on to the copied sheets as the separator for aggregation of documents. The length of the marker paper is determined by a timer F. When this marker paper turns ON and OFF the discharge switch (617), the copying operation of aggregated documents starts and hereinafter the similar routine is repeated.

In this embodiment, two kinds of marker papers are used because it is convenient to use different colors or shapes of interlace papers for the respective number of copies and between aggregations of documents. However, it is also possible to use a kind of interlace paper through change of length, etc.

Moreover, in this embodiment, the documents are sorted using the copy discharging tray and marker papers, separation using a sorter can also be realized by the conventional method.

In this case, the document supply mode is not required to be the circulation type and the circulation type can be reset for connection of the sorter.

Moreover, in this embodiment, a number of stages of documents, a number of sheets of documents and a number of copies are set as the reservation example but it is naturally possible that a magnification factor and the kind of copying paper can also be added as the reservation function.

The above embodiment emphasizes the ending time of a copying operation but it is naturally possible for the embodiment to emphasize the time of inputting reservation data and to judge the copying sequence from the lead or delay of such time.

What is claimed is:

1. A programmable copying apparatus for carrying out a copy operation under a preset program comprising:

means for supporting plural groups of documents for copying;

means for feeding a document from said document support means to a copy station;

copy means for copying any document fed on the copy station;

memory means for storing the copy conditions for each document group supported by said document support means;

means for inputting the copy conditions of each document group into said memory means;

means for controlling said document feed means and said copy means in accordance with said copy conditions stored in said memory means;

time calculation means for calculating a completion time, at which the copy operation in accordance with the input conditions will be completed by calculating a required time to be spent to complete the copy operation based on the input copy conditions and adding the required time to the present time when the copy conditions are input; and means for displaying said completion time.

2. A programmable copying apparatus for carrying out a copy operation under a preset program comprising:

a plurality of document support means for supporting documents to be copied;

document feed means for feeding the documents from said document support means to a copy station;

copy means for copying the document fed on the copy station;

memory means having a plurality of memory areas corresponding to said document support means for memorizing copy conditions of each document group supported by said document support means;

input means for inputting the copy conditions of each document group into a memory area of said memory means;

copy control means for controlling the document feed operation of said document feed means and the copy operation of said copy means under said copy conditions memorized in said memory means;

time calculation means for calculating a completion time, at which the copy operation in accordance with the input condition will be completed, for every input operation corresponding to the plurality of document support means by calculating a required time to be spent to complete the copy operation based on the input copy conditions and adding the required time to a present time period when the copy conditions are input to determine a completion time; and display means for displaying said completion time.

3. A programmable copying apparatus as claimed in claim 2, wherein said input means comprises numeric keys for inputting numerical numbers and function keys for designating the memory areas to memorize the numerical numbers input by the numeric key.

4. A programmable copying apparatus as claimed in claim 3, wherein said memory areas have a plurality of memory parts corresponding to the number of the copy conditions.

5. A programmable copying apparatus as claimed in claim 4, wherein said copy conditions include at least a number of duplication, a number of documents and a designation of one of said document support means.

6. A programmable copying apparatus as claimed in claim 5, further comprising means for inputting the copy number of duplication into every memory area when the designation of one of said document support means is not input.

7. A programmable copying apparatus for carrying out a copy operation under a preset program comprising:

a plurality of document support means for supporting documents to be copied;

document feed means for feeding the documents from said document support means to a copy station;

copy means for copying a document fed onto the copy station;

memory means having a plurality of memory areas corresponding to said document support means for memorizing the copy conditions of each document group supported by said document support means;

input means for inputting the copy conditions of each document group into each memory area of said memory means;

copy control means for controlling the document feed operation of said document feed means and the copy operation of said copy means in accordance with said copy conditions memorized in said memory means; and memory clear means for clearing out the memory area corresponding to the document support means which has completed the copy operation.

8. A programmable copying apparatus as claimed in claim 7, further comprising means for detecting a document on said support means, wherein said memory clear means clears out the memory area in response to the detection by said detecting means.

9. A programmable copying apparatus for carrying out a copy operation under a preset program comprising:

a plurality of document support means for supporting documents to be copied;

document feed means for feeding the documents from said document support means to a copy station;

copy means for copying a document fed onto the copy station;

memory means having a plurality of memory areas corresponding to said document support means for memorizing copy conditions of each document group supported by said document support means;

input means for inputting the copy conditions of each document group into each memory area of said memory means;

copy control means for controlling the document feed operation of said document feed means and copy operation of said copy means in accordance with said copy conditions memorized in said memory means; and display means for displaying the status of each memory area of said memory means.

10. A programmable copying apparatus as claimed in claim 9, wherein said display means displays different colors in accordance with the status of said memory areas.

* * * * *